US006610246B1

(12) United States Patent
Sunamoto

(10) Patent No.: US 6,610,246 B1
(45) Date of Patent: Aug. 26, 2003

(54) SINTERING METHOD AND SINTERING APPARATUS

(75) Inventor: Kenichi Sunamoto, Hiroshima (JP)

(73) Assignee: Akane Co., Ltd., Hiroshima (JP)

( * ) Notice: Subject to any disclaimer, the term of this patent is extended or adjusted under 35 U.S.C. 154(b) by 0 days.

(21) Appl. No.: 09/341,901

(22) PCT Filed: Jan. 20, 1998

(86) PCT No.: PCT/JP98/00195

§ 371 (c)(1),
(2), (4) Date: Jun. 28, 2002

(87) PCT Pub. No.: WO98/31492

PCT Pub. Date: Jul. 23, 1998

(30) Foreign Application Priority Data

Jan. 20, 1997 (JP) ..... 9-007547

(51) Int. Cl.[7] ..... B22F 3/12
(52) U.S. Cl. ..... 419/52; 419/48; 425/78
(58) Field of Search ..... 419/48, 52; 425/78

(56) References Cited

U.S. PATENT DOCUMENTS 2,195,297 A * 3/1940 Engle ..... 75/137
3,665,151 A * 5/1972 Piper ..... 219/149
4,325,734 A * 4/1982 Burrage et al. ..... 75/225
4,414,028 A * 11/1983 Inoue ..... 419/31
4,704,252 A * 11/1987 Pfaffmann ..... 419/49
4,853,178 A * 8/1989 Oslin ..... 419/23
5,178,691 A * 1/1993 Yamashita et al. ..... 148/101
5,340,533 A * 8/1994 Stangle ..... 419/45
5,427,660 A * 6/1995 Kamimura et al. ..... 204/130
5,623,727 A * 4/1997 Vawter ..... 419/51
5,794,113 A * 8/1998 Munir et al. ..... 419/45
5,993,734 A * 11/1999 Snowman et al. ..... 419/48

FOREIGN PATENT DOCUMENTS

JP 54-61077 5/1979
JP 5-117707 5/1993
JP PCT/JP98/00195 1/1997

* cited by examiner

*Primary Examiner*—Daniel J. Jenkins
(74) *Attorney, Agent, or Firm*—Morrison & Foerster LLP

(57) ABSTRACT

A powder material is put into a cylindrical mold and electrodes are brought into contact with the side surface of the mold and a current is applied to sinter the material in the mold while a pressure is applied to the material. In this process, local temperature difference is kept as small as possible. A pair of electrodes are brought into contact with the side circumferential surface of a cylindrical mold (25) filled with a powder material (28) to which a pressure is applied and a current is applied to the mold (25) to heat the powder material (28) in the mold (25) and a sintered body is obtained. In order to sinter the material by the current application through the pair of electrodes, two pairs of electrodes **(19*a*, 19*b*, 19*c*, 19*d*) which face each other are all brought into contact with the side surface of the mold (25) and the current is supplied through the electrodes (19) alternately. By this method, the current application contacts of the electrodes are changed with a lapse of time, local temperature difference in the mold (25)** during the sintering can be avoided.

24 Claims, 17 Drawing Sheets

SINTERING METHOD AND SINTERING APPARATUS

TECHNICAL FIELD

The present invention relates to a sintering method and a sintering apparatus for use in the sintering method.

BACKGROUND TECHNOLOGY

A sintering apparatus is known which is of a type sintering a powder material by applying a current to a mold while applying pressure thereto. The present inventor has previously developed a sintering apparatus of a current-applying type, as shown in FIGS. 19 and 20, which comprises a cylindrical mold (e.g., made of carbon or graphite; an outer diameter: about 180 mm; coaxial length: about 60 mm) 102 for accommodating a powder material 101, upper and lower punches 103*a* and 103*b*, respectively, disposed in the mold 102 so as to be movable for applying pressure to the powder material 101 filled in the mold 102, and a pair of electrodes 104*a* and 104*b* for forming the powder material 101 into a sintered article by applying a current to the mold 102 from the side thereof (as indicated by the broken-lined arrow in FIG. 20) and applying heat to the powder material 101.

As the sintering process apparatus of this current-applying type can lower a sintering temperature by elevating a pressure to be applied to the powder material 101 by means of the upper and lower solid punches 103*a* and 103*b*, respectively, the sintering process can reduce influences of the sintering temperature upon a rate of the oxidative loss of the mold 102 and the like as well as shorten the time for cooling the mold and the like after sintering, up to a level that can make the rate of the oxidative loss negligible. As a consequence, the sintering process of this type can control the oxidative loss in the mold 102 and the like and shorten a cycle time for sintering processes.

As a result of further extensive research on the sintering process conducted by the present inventor, it was found that the rise of the temperature at positions P1 and P2, which are close to contact locations where the electrodes contact with the side surfaces of the mold, is faster than the rise of the temperature at positions P3 and P4 apart from the contact locations between the electrodes and the side surfaces thereof, and consequently that a local temperature difference may be caused to occur to some extent between the positions, resulting in the fact that a portion where the temperature rise is the highest (around the position P1) is caused to reach the sintering temperature faster than the other portions thereof while maintaining the entire state as it is. This may cause a partially non-sintered portion to be formed in a sintered article as a product (as shown in FIGS. 20 and 21). It is further found that this tendency may become higher as the application of a current at the time of a rise is increased to a higher level in order to shorten the processing time. With this finding taken into account, the present inventor has come to recognition that improvements in this point are to be made in order to improve properties of a sintered article such as strength and the like.

The present invention has been completed on the basis of this finding and it has the object to form a sintered article so as to cause a local temperature difference to occur to the smallest possible extent at the time of sintering a powder material by applying a current thereto.

DISCLOSURE OF THE INVENTION

In order to achieve the object as described above, the present invention as claimed in claim 1 provides a sintering method comprising supplying heat to a powder material filled in a cylindrical mold for accommodating the powder material under pressurized condition by applying a current to the mold with whose surface a pair of electrodes are in contact, wherein:

positions of the pair of electrodes in which they are in contact with the side surfaces of the mold for applying the current are disposed so as to vary with time.

Preferred modes of this embodiment according to the present invention as claimed in claim 1 include modes of the embodiment according to the present invention as claimed in claims 2 to 7.

In order to achieve the object as described above, the present invention as claimed in claim 8 provides a sintering method for sintering the powder material by applying a current thereto, thereto wherein the application of the current is partially suspended.

Preferred modes of this embodiment of the present invention as claimed in claim 8 include modes of the embodiment according to the present invention as claimed in claims 9 to 16.

In order to achieve the object as described above, the present invention as claimed in claim 17 provides a sintering apparatus for sintering the powder material in a cylindrical mold for accommodating the powder material under pressurized condition, in which plural groups, each group composed of a pair of electrodes, are disposed in contact of the side surface of the mold and on the periphery of the mold in such a manner that a current is alternately applied to each group composed of a pair of electrodes.

In order to achieve the object as described above, the present invention as claimed in claim 18 provides a sintering apparatus for sintering the powder material around a cylindrical mold for accommodating the powder material under pressurized condition through plural groups, each group composed of a pair of electrodes disposed on the periphery of the mold, wherein each group composed of a pair of electrodes is allowed to alternately come into contact with the side surface of the mold and apply the current to the mold. Preferred modes of the embodiments of the present invention as claimed in claims 16 and 17 include modes of the embodiments of the present invention as claimed in claims 23 and 24, respectively.

In order to achieve the object as described above, the present invention as claimed in claim 18 provides a sintering apparatus, comprising:

a pair of the electrodes disposed around a cylindrical mold for accommodating the powder material under pressurized conditions and for applying heat to the powder material by applying a current to the side surface of the mold;

current-application adjustment means for adjusting the application of a current to the pair of the electrodes from a power source; and control means for controlling the current-application adjustment means to maintain the pair of the electrodes in a current-applying state with respect to the power source in a usual case, in which the current is being applied to the electrodes from the power source, and partially bring the pair of the electrodes in a current-suspending state with respect to the power source, in which the application of the current from the power source is being suspended. Preferred modes of the embodiment of the present invention as claimed in claim 18 include modes of the embodiments of the present invention as claimed in claims 19 to 24.

The sintering method according to the present invention as claimed in claim 1 can positively apply heat (current)

even to a portion of the mold where the temperature rises at a lower level because contact points between the pair of the electrodes and the side surface of the mold through which the current is applied are configured so as to vary with time by focusing on the fact that the temperature can rise to a higher level at the contact points between the electrodes and the side surfaces of the mold. This configuration of the sintering method can fail to cause a temperature difference to occur to the least possible extent in the mold during the sintering process and therefore provide a sintered article without causing the temperature difference to occur to the least possible extent during the sintering process.

The sintering method according to the present invention as claimed in claim 2 is configured such that three or more electrodes are disposed on the periphery of the mold in a spaced relationship apart from one another in a peripheral direction of the mold, and different two electrodes are optionally selected variably from such three or more electrodes, as an elapse of time, to form a pair of electrodes which are brought into contact with the side surface of the mold. This configuration of the sintering method can vary the contact points of the optionally selected pair of the electrodes with respect to the side surface of the mold with an elapse of time, so that, in this case, too, heat (current) can be positively supplied to a portion of the mold where the temperature rises at a lower level to allow the mold to cause a temperature difference partially to the lowest possible extent during the sintering process and, as a consequence, can form a sintered article while causing the temperature difference to fail to occur at the lowest possible level during the sintering process.

The present invention as claimed in claim 3 provides the sintering method which is configured such that a group consisting of a pair of electrodes is disposed on the periphery of the mold and the group of the pair of the electrodes is disposed so as to deviate its positional relationship relative to the mold in the peripheral direction of the mold as time elapses. This configuration can change the contact points of the pair of the electrodes with the side surfaces of the mold, at which the current is applied to the mold for sintering, as time elapses. Therefore, this sintering method can positively supply heat (current) to a portion of the mold where a rise in the temperature is slower, too thereby causing a local temperature difference to occur in the mold to the least possible extent at the time of sintering and producing a sintered article without causing a partial occurrence of the local temperature difference in the mold.

Further, this embodiment requires only two electrodes so that the number of electrodes can be minimized as small as possible for applying the current to the mold.

The present invention as claimed in claim 4 provides the sintering method wherein the three or more electrodes are all in contact with the side surfaces of the mold; and the two optional electrodes are selected therefrom by shifting the application of the current thereto. This configuration can achieve the same action and effects as achieved by the present invention as claimed in claim 2. Further, this embodiment of the present invention can cause no delay in rise because the disposition of the three or more electrodes does not require contact with or separation from the side surfaces of the mold for selection of the optional two electrodes. If the electrodes are otherwise separated apart from the mold, some period of time is required until heat is supplied to the mold after the electrodes are allowed to contact therewith and then the temperature of the mold is elevated because the temperature of the mold is caused to be lowered while the electrodes are separated from the mold. Therefore, this embodiment does not cause the temperature of the mold to vary (to be lowered) to a great extent upon shifting the electrodes, so that the temperature difference of the mold can be controlled to an appropriate level.

The invention as claimed in claim 5 further provides the sintering method wherein the two optional electrodes are selected by causing the electrodes to contact with or separate apart from the side surface of the mold. Therefore, this embodiment of the present invention can achieve the action and effects more specifically as achieved by the embodiment of claim 2.

The sintering method of the present invention as claimed in claim 6 is configured such that three or more electrodes are disposed; two groups of pairs of electrodes are selected from the three or more electrodes; and said two groups of the pairs of the electrodes are disposed so as for a virtual line connecting a one group consisting of the pair of the electrodes to each other to intersect another virtual line connecting the other group consisting of the pair of the electrodes of another group to each other at the substantially right angle; wherein the current is alternately applied to the groups of the pairs of the electrodes. This configuration can readily control each of the groups of the pairs of the electrodes by predetermining each of the pairs of the electrodes as each group. In addition, this configuration can effectively control an occurrence of a local temperature difference in the mold at the time of sintering by minimizing the number of the electrodes as small as possible.

The present invention as claimed in claim 7 provides the sintering method wherein the current is applied to the one group of the pair of the electrodes selected from the two groups thereof at an initial time of applying the current until the temperature of the mold reaches a predetermined temperature; and thereafter the current is intermittently applied at small time intervals alternately to each of the two groups of the pairs of the electrodes. Therefore, the temperature difference in the mold can be made as small as possible and the processing time can be shortened to some extent, so that the above two features can be satisfied greatly.

Further, the present invention as claimed in claim 8 provides the sintering method for sintering the powder material filled in the mold by applying a current to the mold in a manner that the current applied to the mold is partially suspended. This configuration can transfer heat (perform heat conduction) from the high-temperature portion of the mold to the low-temperature portion thereof to reduce local temperature difference even if a higher portion of raising the temperature in the mold would be caused to occur locally by sintering upon the application of the current thereto. Therefore, a sintered product can be produced without causing local temperature difference to the highest possible extent at the time of sintering, while utilizing heat effectively.

The sintering method as claimed in claim 9 is provided with the step of supplying heat to the powder material filled in the cylindrical mold under pressurized conditions for sintering by applying the current to the mold while the pair of the electrodes are in contact with the side surfaces of the mold. Therefore, this configuration presents the situation that a portion where the temperature becomes higher than the other portions is likely to be located due to a higher rate of elevating the temperature locally on account of the side surface of the mold where there is the limitation on processing precision or the like, a small contact area between the side surface of the mold and the electrodes, etc.; however, the suspension of the application of the current permits the heat to transmit from the higher-temperature portion to the lower-temperature portion in the mold, and a sintered article can be produced in such a manner that local temperature difference is reduced to the least possible extent at the time of sintering.

Moreover, the present invention as claimed in claim 9 provides the sintering method wherein the pair of the electrodes are separated apart from the side surface of the mold upon suspending the application of the current for sintering the powder material. This configuration can prevent heat in the mold from leaking toward outside through the electrodes at the time when the application of the current is suspended. Therefore, the heat present in the mold can be effectively utilized upon transferring the heat in the mold from its higher-temperature portion to its lower-temperature portion.

Additionally, the sintering method as claimed in claim 10 is configured such that, as each of the electrodes is disposed so as for a tip portion thereof to come closer to or separate apart from the main body of the mold in such a manner that, when the tip portion thereof is separated apart from the main body thereof, a space area is formed between the tip portion thereof and the main body, heat in the mold can be prevented from escaping through the electrodes by the location of the heat-insulating space area, even if the electrodes are kept in contact with the side surface of the mold. Therefore, the heat present in the mold can be utilized to a highly effective extent upon transferring the heat from the higher-temperature portion to the lower-temperature portion thereof.

The present invention as claimed in claim 11 provides the sintering method which is configured in that three or more electrodes are disposed in a peripherally spaced relationship on the periphery of the mold, that a pair of two optional electrodes are selected from the three or more electrodes by shifting the electrode, as time elapses, and that, on selecting the pair of two optional electrodes by shifting said electrodes, a period of time during which the application of the current is partially suspended is provided for suspending the application of the current for sintering the powder material. Therefore, the timing of shifting the electrodes can be effectively utilized for correcting the temperature in the mold and making the temperature uniform in the mold, and the shifting of the electrodes can be effected in a smooth way.

In a preferred mode of this embodiment, the sintering method as claimed in claim 13 is configured such that the mold is made of graphite. This configuration can provide the mold with thermal resistance, thermal shock resistance, and conductivity at such a level as required for use as a mold. This configuration, however, may otherwise create the situation in which a portion is caused to locate in the mold where the temperature is higher than the other due to the fact the rate of transferring heat in the mold is slower as compared with the rate of supplying heat from the electrodes. Therefore, in this situation, the suspension of the application of the current to the mold can accelerate the heat conduction from the higher-temperature portion to the lower-temperature portion to reduce local temperature difference in the mold, and a sintered product can be produced in a situation where such local temperature difference is very low at the time of sintering.

In addition, in a preferred mode of the embodiment, the present invention as claimed in claim 13 provides the sintering method, wherein the application of the current is suspended when local temperature difference between two predetermined positions of the mold reaches a predetermined temperature difference or larger. Therefore, this mode of the embodiment according to the present invention can correct the temperature in the mold so as to make the temperature in the mold as uniform as possible, while regulating the local temperature difference in the mold from becoming too large by supplying heat for sintering the powder material by means of the application of the current thereto.

Furthermore, in another preferred mode of this embodiment, the present invention as claimed in claim 14 provides the sintering method, wherein pressure is applied to the powder material in a state in which the application of heat from the outside is insulated, by taking advantage of the feature that no application of the current is to be performed on the side of applying pressure thereto. This configuration can prevent heat present in the mold from escaping through pressurizing means such as pressurizing punches or the like, so that the heat in the mold and so on can be utilized effectively upon transferring heat in the mold from the higher-temperature portion to the lower-temperature portion thereof.

Still further, in another preferred mode of this embodiment, the present invention as claimed in claim 15 provides the sintering method, wherein the application of the current to the mold is suspended plural times. This configuration can perform the suspension of the application of the current to the mold more effectively for correcting the temperature of the mold toward making the temperature in the mold uniform.

In another aspect, the present invention as claimed in claim 16 provides a sintering apparatus for sintering a powder material filled in a cylindrical mold by alternately applying a current to the mold through a pair of electrodes disposed in contact with the peripheral side surfaces of the mold, wherein plural groups, each group composed of a pair of electrodes, are disposed on the periphery of the mold while being in contact with the side surface of the mold; and each group composed of the pair of electrodes are selected to alternately apply the current to the mold. Therefore, the sintering apparatus in this embodiment can be configured so as to change the contact points at which the pair of the electrodes come into contact with the side surface of the mold in accordance with a lapse of time so that the present invention can specifically provide the sintering apparatus that can practice the sintering methods according to the embodiments as claimed in claims 1, 2, 4, 6 and 7.

Further, the sintering apparatus for sintering the powder material filled in the cylindrical mold as claimed in claim 13 is likewise configured such that the mold is supplied with the current through a pair of electrodes disposed in contact with the peripheral side surface of the mold, wherein plural groups, each group composed of a pair of electrodes, are disposed on the periphery of the mold and each group is selected so as to come into contact with the side surface of the mold and apply the current to the mold. In this embodiment, too, the sintering apparatus in this embodiment can be configured such that the contact points at which the pair of the electrodes come into contact with the side surfaces of the mold can be varied with a lapse of time, thereby providing the apparatus that can specifically practice the sintering methods according to the embodiments as claimed in claims 1, 2, and 5.

Moreover, the sintering apparatus of the present invention as claimed in claim 18 is provided with a pair of electrodes disposed on the periphery of the cylindrical mold for accommodating the powder material under pressurized conditions for applying heat to the powder material by applying the current to the mold; a current-application adjusting means for adjusting application of the current to the pair of electrodes from a power source; and a control means for controlling the current-application adjusting means to assume a current-applying state at a usual time in which the current is supplied to the pair of electrodes from the power source and a current-suspending state in which the application of the current to the pair of electrodes is partially suspended. Therefore, the sintering apparatus according to this embodiment can partially suspend the application of the current to the mold so that the it can specifically practice the sintering method as claimed in claim 8.

Furthermore, the present invention as claimed in claim 19 provides the sintering apparatus wherein pressure can be applied to the powder material from both sides of the mold in axial directions by means of a pressurizing punch having a heat insulating layer by utilizing the feature that the current is not required to be applied on the side of the pressurizing punch. Therefore, this configuration can control the heat in the mold from escaping through the pressurizing means so that the heat in the mold and so on can be utilized effectively upon transferring heat from the higher-temperature portion of the mold to the lower-temperature portion thereof. This configuration can provide the sintering apparatus that can specifically perform the sintering method as claimed in claim 14.

In addition, in a preferred mode of the above embodiment, the sintering apparatus as claimed in claim 10 is configured such that the mold is made of graphite. This configuration can provide the mold with thermal resistance, thermal shock resistance, and conductivity at such a level as required for use as a mold. This configuration, however, may otherwise create the situation in which a portion is caused to locally locate in the mold where the temperature is higher than the other due to the fact the rate of transferring heat in the mold is slower as compared with the rate of supplying heat from the electrodes. In this situation, the suspension of the application of the current to the mold can accelerate the heat conduction from the higher-temperature portion of the mold to the lower-temperature portion thereof to reduce a local temperature difference in the mold. Accordingly, this embodiment can provide the sintering apparatus that can specifically perform the sintering method as claimed in claim 12.

In a preferred mode, the sintering apparatus of the present invention as claimed in claim 22 is configured such that a group of the pair of the electrodes are selected from plural groups of pairs of electrodes which are disposed so as to be shifted in sequence and the control means is set so as to control the current-application adjusting means to implement the current-application suspending state, when it is judged to perform the shift of the electrodes. This arrangement of the sintering apparatus can utilize the timing of performing the shift of the electrodes for correction of the temperature of the mold for making the temperature in the mold uniform and perform the shifting of the electrodes in a smooth way. Therefore, this embodiment of the present invention can provide the sintering apparatus that can specifically practice the sintering method as claimed in claim 11.

Further, the present invention as claimed in claim 12 provides the sintering apparatus further comprising a mold temperature detecting means for detecting the temperature of the mold in plural positions; wherein the control means is set so as to perform the current-suspending state by controlling the current-application adjusting means when it is judged that a temperature difference in two positions out of the plural positions reaches a predetermined temperature difference or larger on the basis of a signal from the mold temperature detecting means. This configuration of the sintering apparatus can regulate the temperature difference from becoming too large by the application of heat on the basis of sintering by the application of the current to the mold. Moreover, it can correct the temperature of the mold for making the temperature in the mold uniform.

Therefore, this embodiment of the present invention can provide the sintering apparatus that can specifically perform the sintering method as claimed in claim 13.

In a preferred mode of the above embodiments of the present invention, the sintering apparatus as claimed in claim 23 is configured such that a temperature detector is disposed so as to contact with or separate apart from the side surface of the mold. This configuration can detect the temperature of the mold in an accurate way simply by allowing the temperature detector to be in contact with the side surface of the mold, and serve as automating the detection of the temperature in the mold. At the same time, this configuration serves as saving mounting work for mounting the temperature detector such as a thermocouple or the like on the mold, and, if the temperature detector would be mounted thereon, it can prevent an error in measurement from becoming large.

In another preferred mode of the above embodiments, the present invention as claimed in claim 14 provides the sintering apparatus, wherein a thermocouple is disposed in a tip portion of the electrode. The electrodes can serve as a temperature detector so that the temperature of the mold can be measured by allowing the electrodes to contact with the side surfaces of the mold. Therefore, this embodiment of the sintering apparatus can achieve the action and effects as that as claimed in claim 23 and at the same time serve as simplifying the apparatus.

BEST MODES FOR CARRYING OUT THE INVENTION

The present invention will be described in more detail by way of embodiments with reference to the accompanying drawings.

First, a description will be made of a sintering apparatus of the present invention for use in a sintering method according to the present invention before a description of the sintering method in accordance with embodiments of the present invention.

Figure 1:
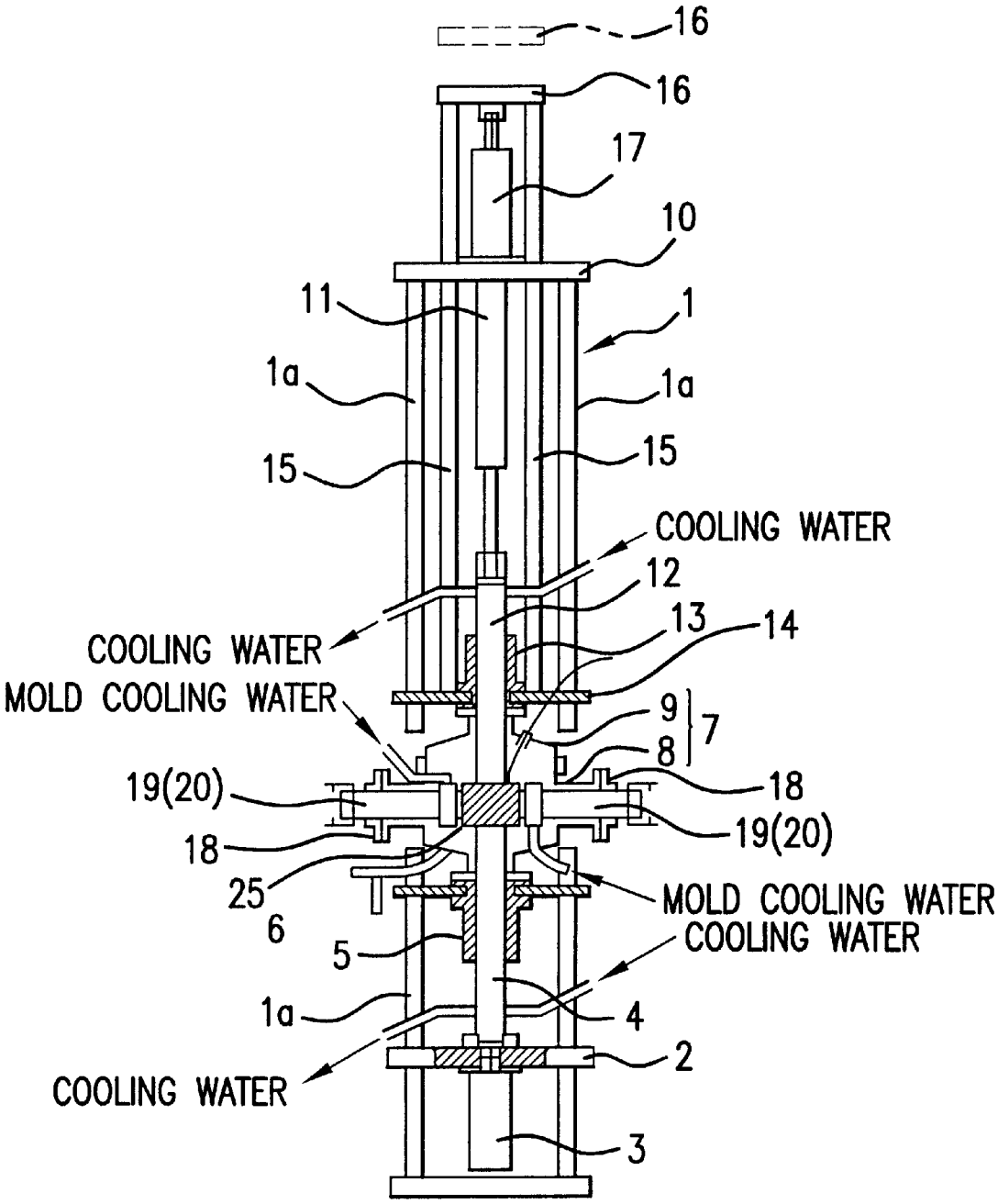
FIG. 1 is a schematic view showing a sintering apparatus according to a first embodiment of the present invention.

As shown in FIG. 1, reference numeral 1 denotes a frame member having a lower recipient base 2 disposed below the frame member 1, and a cylinder unit 3 is fixed on the lower recipient base 2. To the cylinder unit 3 is connected a mold lift bar 4 on the side above the lower recipient base 2, and the mold lift bar 4 is disposed so as to be movable in upward and downward directions by means of contractible and extendable movements of the cylinder unit 3.

On the outer periphery of the mold lift bar 4 is engaged a cylindrical stopper 5 as shown in FIG. 1. On the outer periphery of the cylindrical stopper 5 is in turn mounted a support plate 6 which is engaged with and held with (secured to) a side frame 1*a* of the frame member 1.

Figure 2:
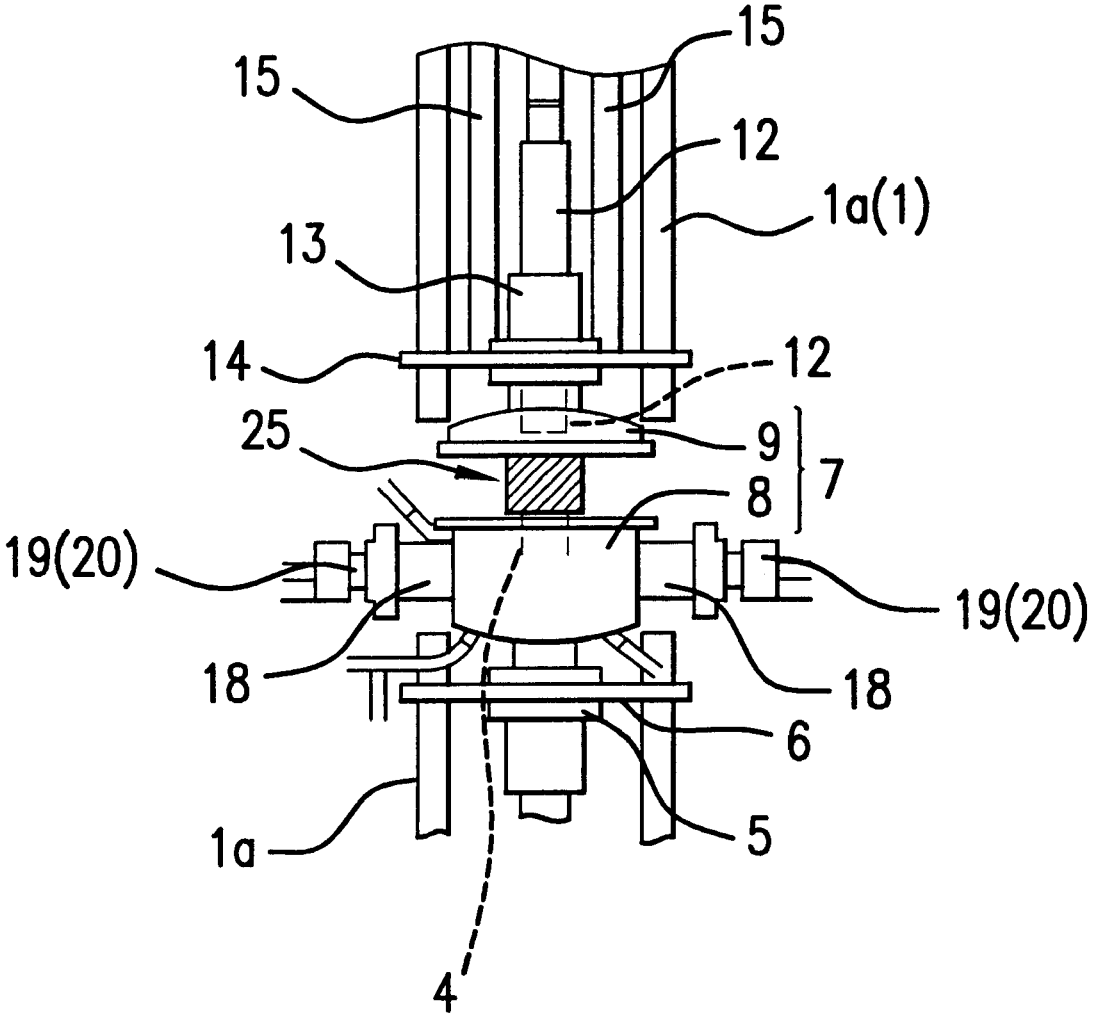
FIG. 2 is a schematic view for describing the insertion or discharge of a mold and so on in the sintering apparatus of FIG. 1.
Figure 3:
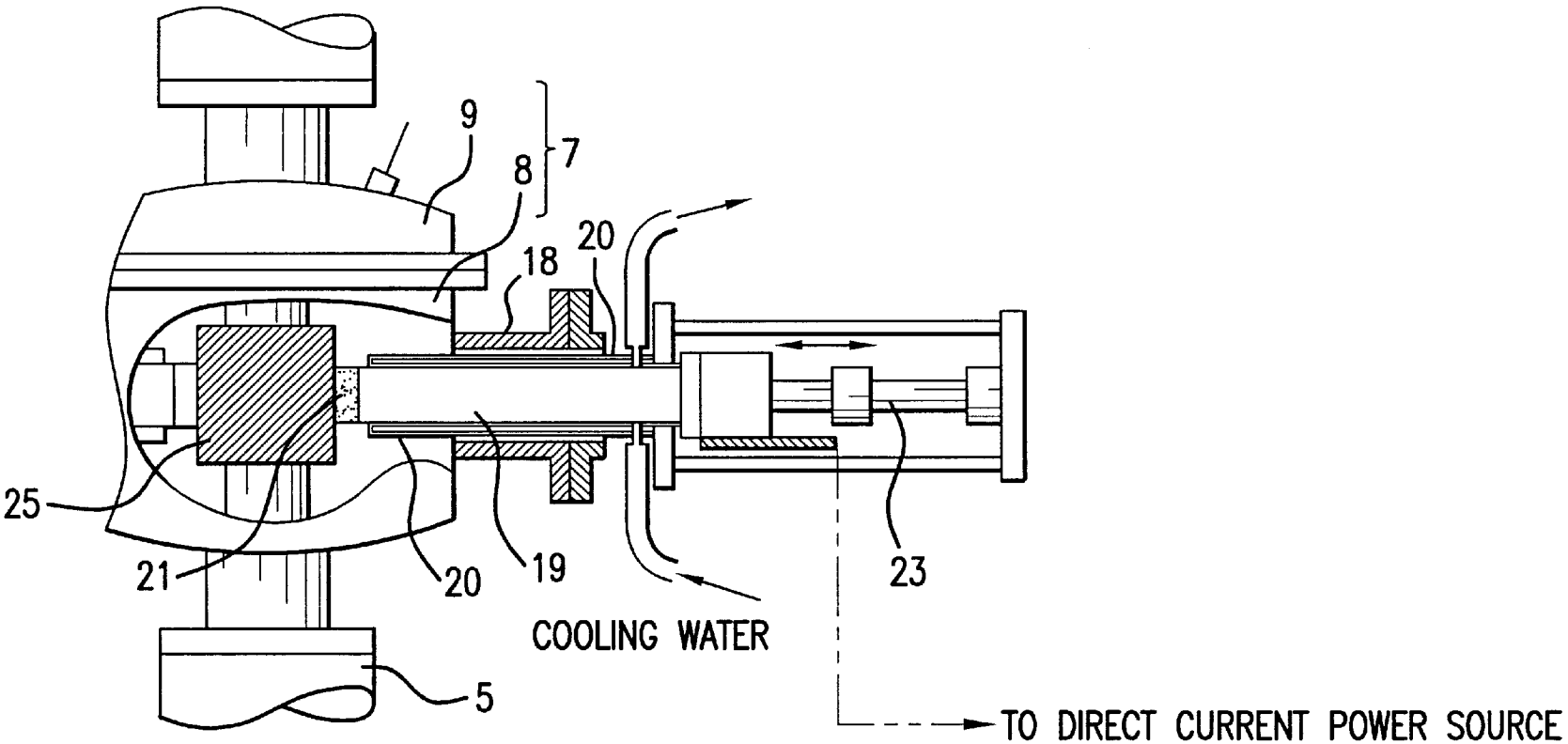
FIG. 3 is a partially enlarged schematic view showing the sintering apparatus of FIG. 1.

A vacuum chamber 7 is disposed on the cylindrical stopper 5 in the manner as shown in FIGS. 1 to 3. The vacuum chamber 7 comprises a chamber body 8 and a lid member 9, and the inside of the vacuum chamber 7 is made in a vacuum state by sucking the chamber with a vacuum pump, although not shown. In the chamber body 8 of the vacuum chamber 7 is inserted the mold lift bar 4 from the lower portion of the chamber body 8 so as to be movable, and a space between the mold lift bar 4 and the chamber body 8 is kept in an airtight state.

On the upper portion of the frame member 1 is disposed an upper recipient table 10, and a cylinder unit 11 is secured to the lower side of the upper recipient table 10. To the cylinder unit 11 is connected a mold pressing bar 12 on the side below the cylinder unit 11, and the mold pressing bar 12 is disposed so as to be movable in upward and downward directions by means of contractible and extendable movements of the cylinder unit 11.

On the outer periphery of the mold pressing bar 12 is slidably engaged a sliding cylindrical tube 13 as shown in FIGS. 1 and 2. At the lower portion of the sliding tube 13 is fixed the lid member 9 of the vacuum chamber 7, and the mold pressing bar 12 is disposed inserting in the lid member 9 so as to be movable while maintaining its airtight state.

Further, a support plate 14 is mounted on the outer periphery of the sliding tube 13 over the lid member 9, and the support plate 14 is engaged with a side frame 1*a* of the frame member 1 so as to be slidable. To the upper surface of the support plate 14 are connected a plurality of guide rods 15 with their one ends fixed to the upper surface of the support plate 14 and with the other ends thereof extending through the upper recipient table 10 upwardly over its entire length and being connected to a connecting plate 16. To the connecting plate 16 is in turn connected a cylinder unit 17 fixed to the upper recipient table 10. This configuration can move the lid member 9 so as to come closer to and go apart from the chamber body 8 (i.e. to open and close the chamber body 8) through a guide rod 15 and the support plate 14 by means of the extendable and contractible movements of the cylinder unit 17.

Figure 4:
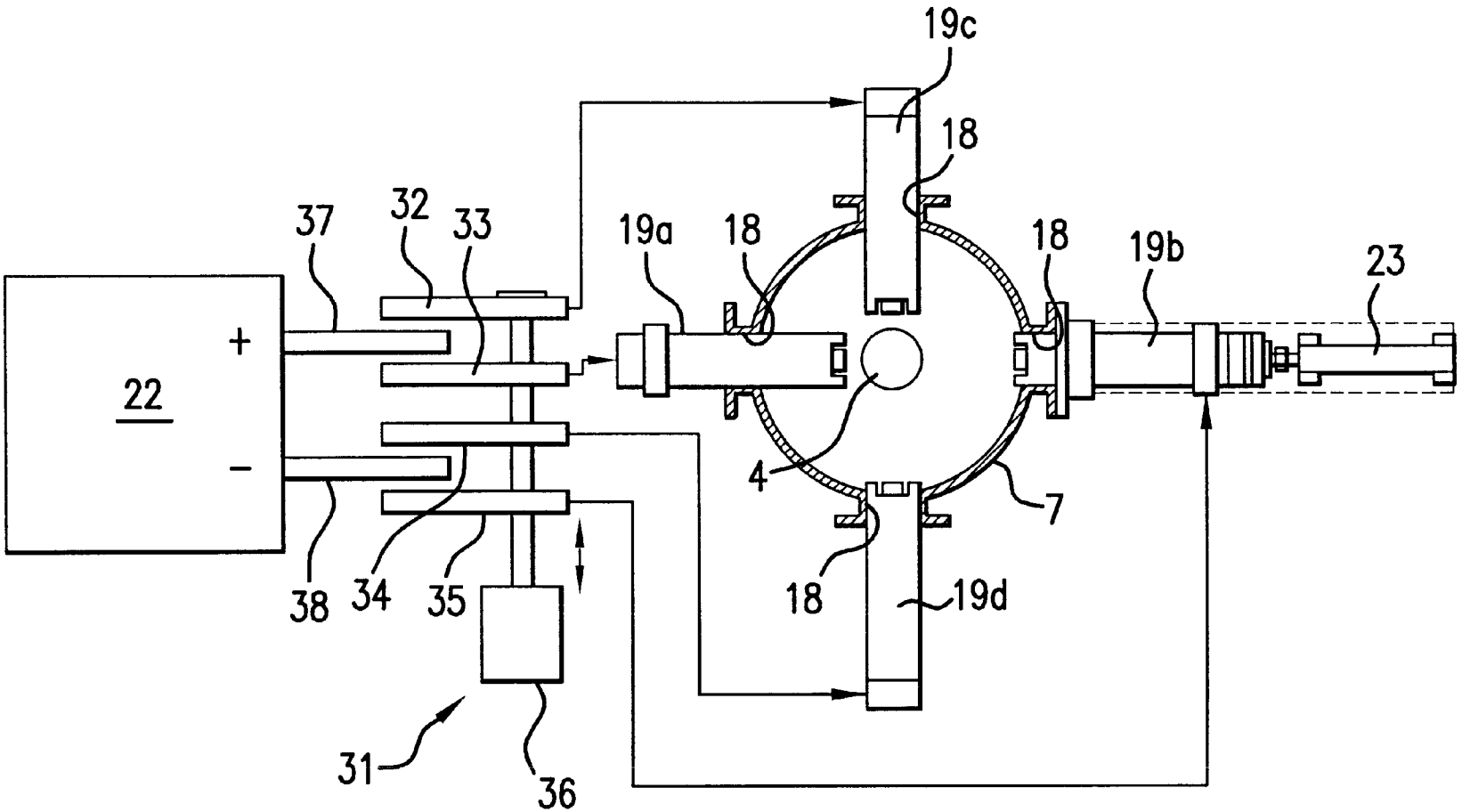
FIG. 4 is a schematic view of the operation of electrodes.

As shown in FIG. 4, the vacuum chamber 7 is provided at its side portion with four insertion holes, as indicated generally as reference numeral 18, communicating with the vacuum chamber 7, which are disposed on the peripheral side of the vacuum chamber 7 in a peripheral direction in equally spaced relationship. Each of the insertion holes 18 is disposed so as to form a pair of the insertion holes 18 together with the opposite insertion hole 18 that is located in the position extending orthogonally through the center of the vacuum chamber 7. Therefore, the four insertion holes 18 form two groups each including a pair of the insertion holes 18.

Into the insertion holes 18 are movably inserted electrodes 19*a*, 19*b*, 19*c* and 19*d*, which are referred to in common as reference numeral 19, in an airtight manner. Each of the electrodes 19 is made of the identical configuration and a top portion 21 of each electrode 19 is formed with material, such as carbon, graphite, etc., which may preferably have resistance lower than an intrinsic resistance to electricity in order to prevent a partial contact. The top portion 21 of each electrode 19 is positioned within the vacuum chamber 7. To each of the electrodes 19 is connected a cylinder unit 23 fixed to a fixing means, although not shown. In FIG. 4, the cylinder unit 23 is not shown for each of the electrodes 19*a*, 19*b*, 19*c* and 19*d*. Each of the electrodes 19 is disposed so as to move radially with respect to the vacuum chamber 7 by means of the respective cylinder units 23.

Among the electrodes 19, the electrodes 19*a* and 19*b* are disposed on the opposite sides of the vacuum chamber 7 to form a one group that coincides with a one group of the insertion holes 18 while the electrodes 19*c* and 19*d* are disposed on the opposite side thereof to form another group that coincides with the other group of the insertion holes 18.

FIG. 4 indicates the embodiment in which only the electrodes 19*a* and 19*d*, which does not form a group, are located in the positions closer to the radial center of the vacuum chamber 7, however, it is to be noted herein that this embodiment is merely illustrative of the possible embodiments of the present invention and that all the electrodes 19 may be located in the positions close to the radial center thereof.

Figure 5:
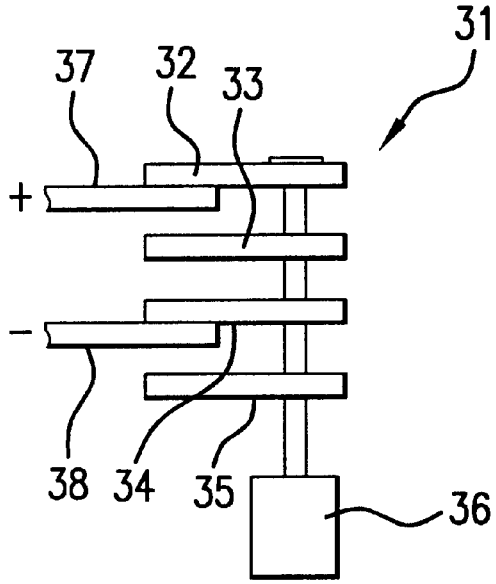
FIG. 5 is a view showing the state of a shift unit in which a current is shifted to another group of a pair of electrodes.
Figure 6:
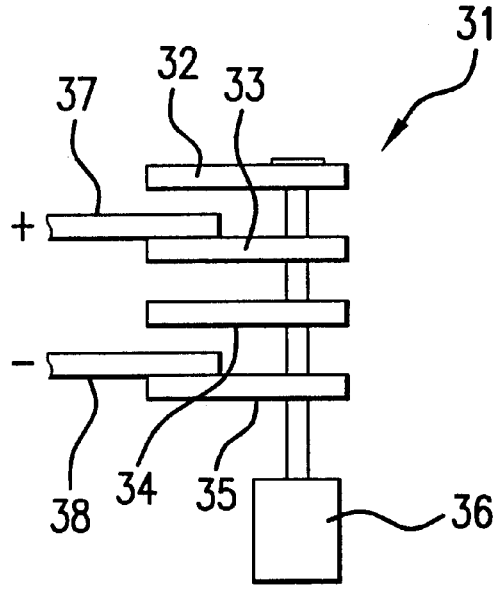
FIG. 6 is a view showing the state of a shift unit in which a current is shifted to a one group of a pair of electrodes.

To a base end portion of each electrode 19 is connected a shift unit 31, as shown in FIG. 4. The shift unit 31 comprises four joint terminals 32 to 35, inclusive, such as made from copper bars, which are disposed in a spaced relationship apart in a predetermined distance from one another. The four joint terminals 32 to 35 are disposed so as to be drivable integrally with one another by means of an actuator 36. The joint terminal 32 is connected to the electrode 19*c*, the joint terminal 33 to the electrode 19*a*, the joint terminal 34 to the electrode 19*d*, and the joint terminal 35 to the electrode 19*b*. Further, a plus terminal 37, such as a copper bar, for a direct current power source 22 is interposed between the joint terminals 32 and 33 of the shift unit 31, while a minus terminal 38, such as a copper bar, for the direct current power source 22 is interposed between the joint terminals 34 and 35 thereof. The activation of the actuator 36 allows the plus terminal 37 for the direct current power source 22 to contact with the joint terminal 32, while allowing the minus terminal 38 of the direct current power source 22 to contact with the joint terminal 34, as shown in FIG. 5, thereby applying a voltage to the electrodes 19*c* and 19*d*, respectively. On the other hand, when the actuator 36 is activated, the plus terminal 37 for the direct current power source 22 is allowed to contact with the joint terminal 33 and, at the same time, the minus terminal 38 therefor is allowed to contact with the joint terminal 35, as shown in FIG. 6, a voltage is applied to the electrodes 19*a* and 19*b*, respectively.

As shown in FIG. 3, a cooling cylinder 20 is engaged on the outer periphery of each electrode 19. The cooling cylinder 20 may be of a hollow structure into which cooling water is supplied. This cooling water present in the cooling cylinder 20 can protect the electrodes 19 from heat while the current is being applied thereto. On the other hand, when no current is being applied, i.e., when no heat is supplied from each electrode 19 to a mold 25, the temperature of each electrode 19 is allowed to become lower, as compared with applying the current thereto, thereby allowing each of the electrodes 19 itself to function as a cooling stick.

Figure 8:
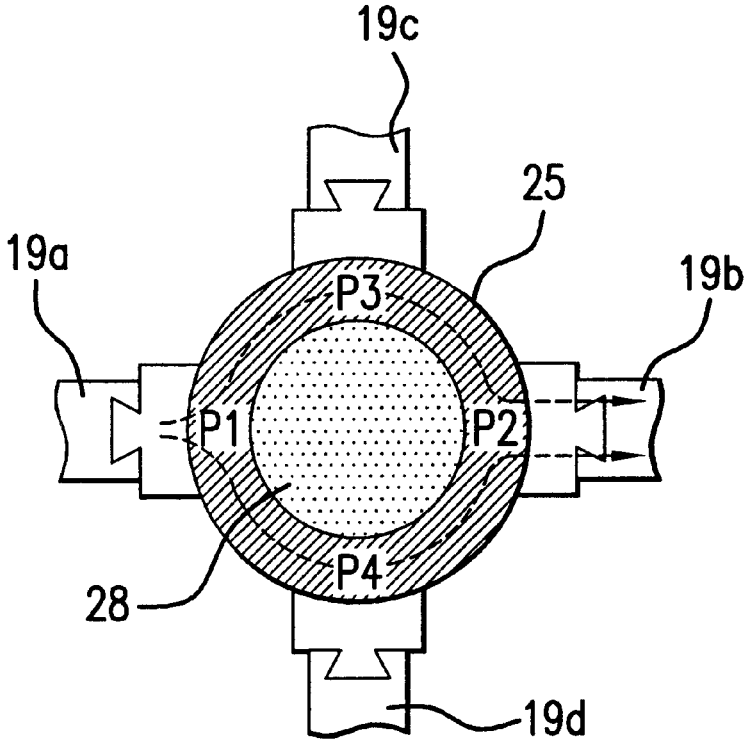
FIG. 8 is a transverse view in section of FIG. 7.

As shown in FIGS. 1 to 3, the mold 25 and the upper and lower punches 26 and 27 are disposed in the vacuum chamber 7, although not shown in the drawings. (In FIGS. 1–3, the upper and lower punches 26 and 27 are omitted.) The mold 25 may be provided with the function of accommodating powder material 28 as a sintering material, such as copper, aluminum or superhard powder (WC-10CO). At this end, the mold 25 may be of a cylindrical, e.g., tubular, structure made of graphite, carbon, or the like, as shown in FIG. 8. In the vacuum chamber 7, the mold 25 is disposed so as for its axis to be directed in vertical directions, and the peripheral side surface of the mold 25 assumes the mode, as shown in FIG. 8, in which all the groups of the pairs of the electrodes 19 are disposed so as to move closer to the radially central portion of the vacuum chamber 7 and that each of the top portions 21 thereof comes to contact with the peripheral side surface of the mold 25. The shifting of the shift unit 31 then allows each group of the pair of the electrodes 19 to alternately apply the current (as indicated by broken line in FIG. 8) to the mold 25.

The upper punch 26 is displaceably engaged with the inner peripheral surface of the mold 25 from the above while maintaining its liquid tight state. On the other hand, the lower punch 27 is displaceably engaged with the inner peripheral surface of the mold 25 from the below while maintaining its liquid tight state (see FIG. 7). In the vacuum chamber 7, the mold 25 is set on the mold lift bar 4 through the lower punch 27, and the mold pressing bar 12 applies the force for applying pressure to the upper punch 26.

Figure 9:
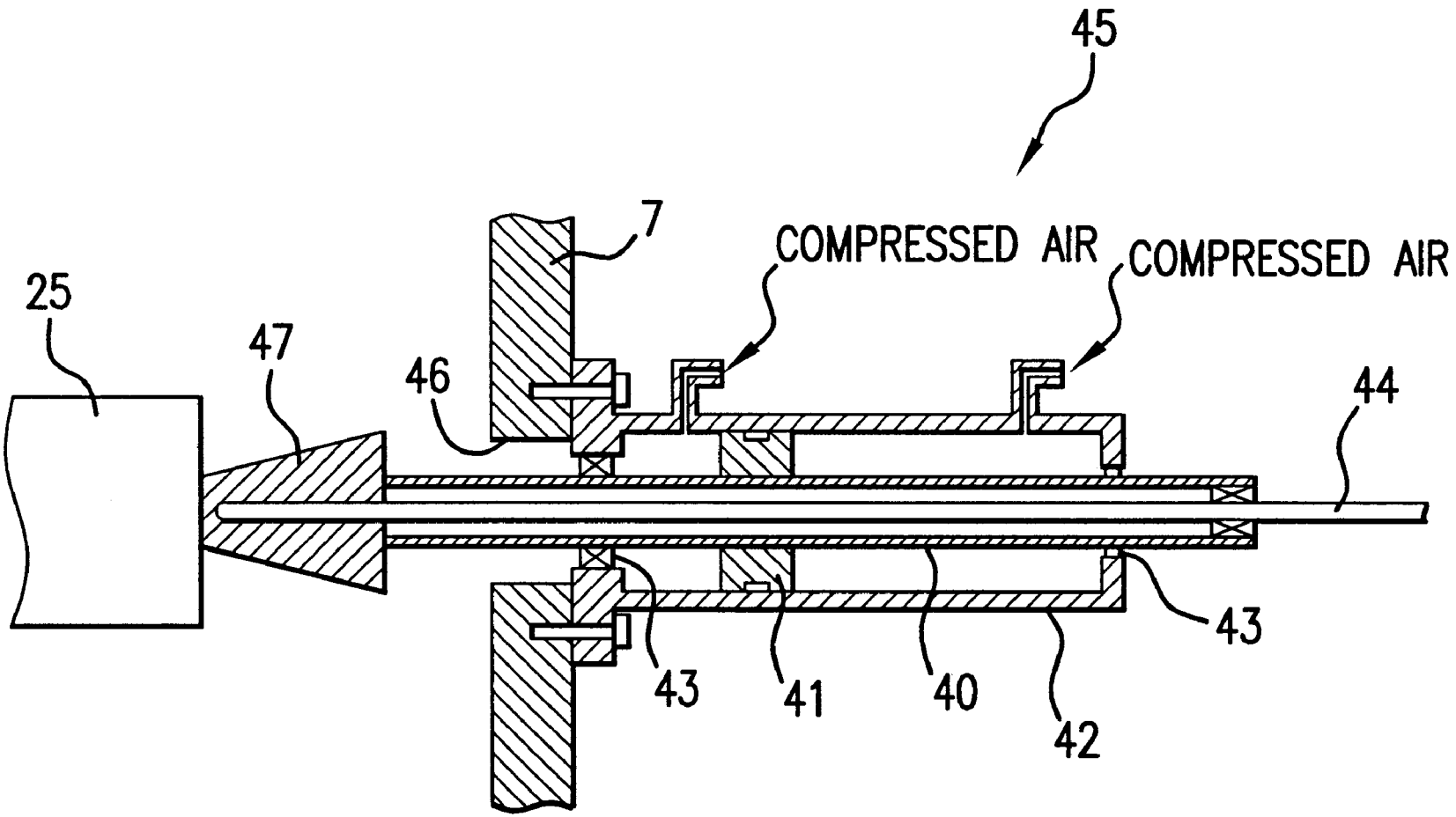
FIG. 9 is a schematic view of a temperature detector to be mounted on a vacuum chamber.

As shown in FIG. 9, the vacuum chamber 7 is provided with an insertion hole 46 through which a temperature detector 45 is inserted. The temperature detector 45 comprises a shaft section 40, a carbon section 47 (which may otherwise be made of graphite or the like) disposed at a tip portion of the shaft section 40, a thermocouple 44 extending from a base end side of the shaft section 40 into the carbon section 47. The temperature detector 45 can measure the temperature of the mold 25 by allowing the carbon section 47 (which may otherwise be made of graphite or the like) to contact with the side surface of the mold 25.

At the outer periphery of the shaft section 40 of the temperature detector 45 is engaged a piston (a ring-shaped member) 41 which in turn is slidably engaged in a cylinder 42 fixed to the vacuum chamber 7 and which defines the cylinder 42 into two compartments into which compressed air is supplied or from which it is discharged. By supplying compressed air to the two compartments or discharging it therefrom, the shaft section 40 can be displaced in the axial direction, and the carbon section 47 can come into contact with the peripheral side surface of the mold 25 disposed in the vacuum chamber 7. In the drawing, reference numeral 43 denotes a packing having an insulating property.

Then, a description will be made of a sintering method according to the present invention, together with the action of the sintering apparatus.

Figure 7:
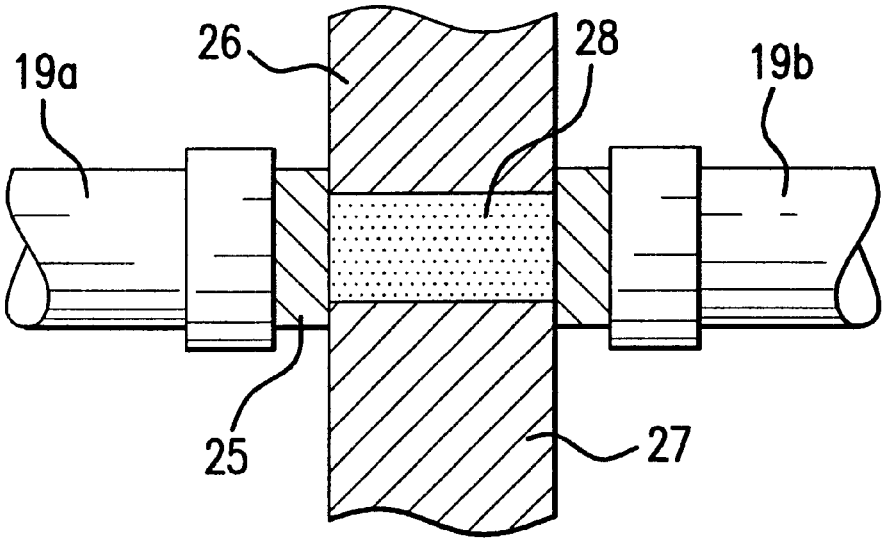
FIG. 7 is a view showing the relationship of a mode with upper and lower punches in the sintering apparatus.

First, as shown in FIG. 7, the mold 25 is filled with powder material 28 (in this embodiment, the powder material may include copper powder), and the powder material 28 is placed in a space of the mold between the upper and lower punches 26 and 27, respectively.

Then, as shown in FIG. 3, the mold 25 is clamped with the upper and lower punches 26 and 27, respectively, by means of the mold lift bar 4 and the mold pressing bar 12. The electrodes 19 are brought into contact with the side surface of the mold 25. This concludes the setting of the sintering process.

Thereafter, the air is sucked from the vacuum chamber 7 to start making the inside thereof vacuum and the mold pressing bar 12 is lowered by the cylinder unit 11. Then, the upper and lower punches 26 and 27, each made of ceramics material, start applying a large amount of pressure to the powder material 28.

Figure 10:
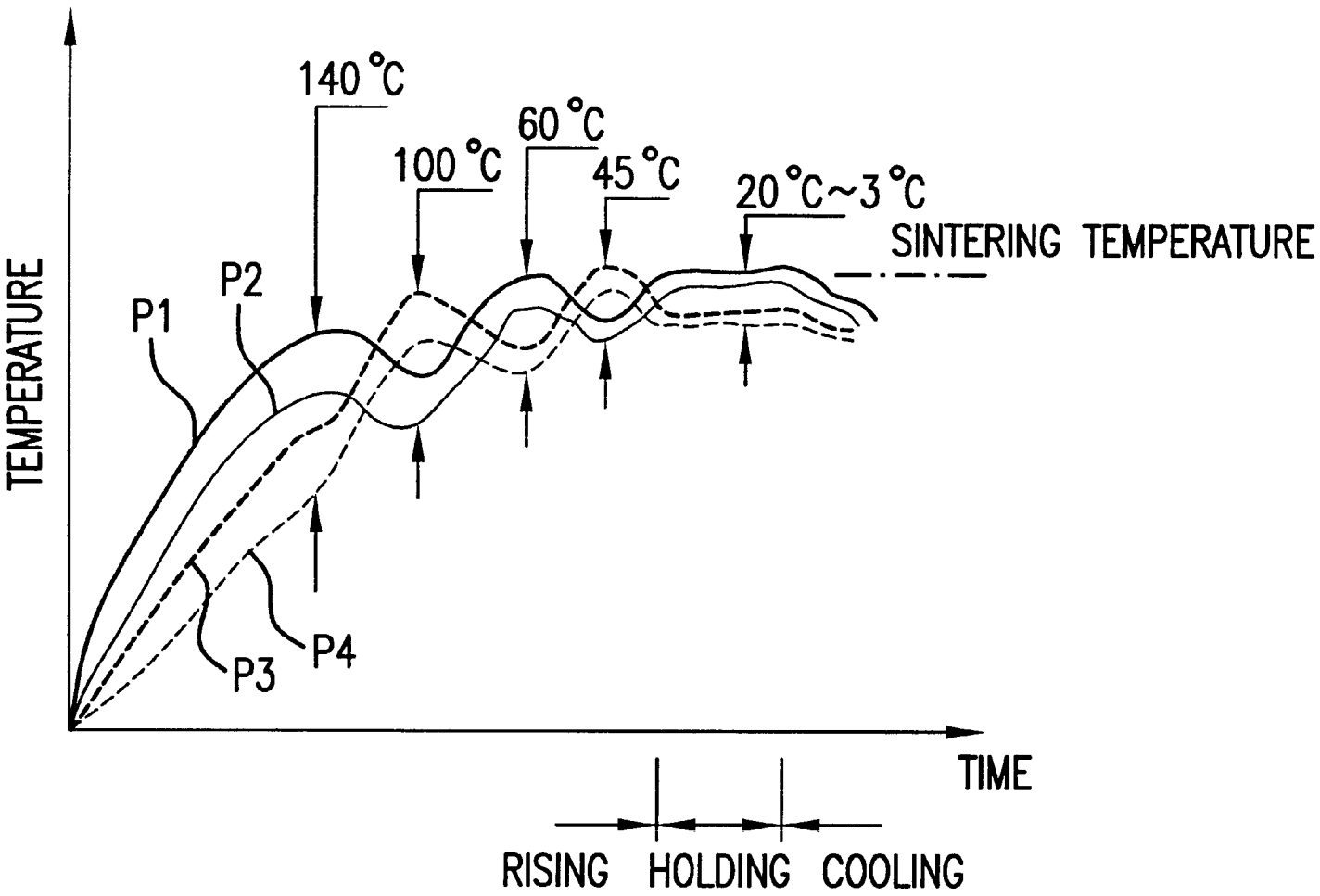
FIG. 10 is a graph showing an example of controlling a rise in temperature of a mold by a pair of electrodes of each of two groups facing each other in accordance with the first embodiment of the present invention.

Then, as a predetermined period of time (e.g., 30 seconds) elapses from the start of the sintering process, voltage is applied to the one group of the pair of the electrodes 19*a* and 19*b* and a current flows from the electrode 19*a* on the one side through the mold 25 to the electrode 19*b* on the other side, thereby allowing the pair of the electrodes 19*a* and 19*b* to apply a current to the mold 25. By applying the current thereto, Joule heat is given the 10 mold 25 and is supplied to the powder material 28 in a pressurized state. As a result, as shown in FIG. 10, the rise of the temperature of the mold 25 at each position becomes higher in the order of positions P4, P3, P2 and P1.

As the temperature of the mold 25 in the position P1 reaches a third-quarter rate of the sintering temperature, e.g., approximately 700° C. (in this embodiment, the sintering temperature is adjusted to reach approximately 900° C. by adjusting the pressurized state of the powder material 28), the shift unit 31 is controlled in such a way that a voltage is applied to the other group of the pair of the electrodes 19*c* and 19*d*, in place of the one group of the pair of the electrodes 19*a* and 19*b*. This operation causes a gradient of the temperature in the positions P1 and P2 to be directed in a downward direction, as shown in FIG. 10. On the other hand, the pair of the electrodes 19*c* and 19*d* apply the current to the mold 25, thereby allowing a gradient of elevation of the temperature of the mold 25 in the positions P3 and P4 to become higher. As a consequence, the temperature in each position of the mold 25 becomes higher in the order of the positions P2, P1, P4 and P3.

Then, the shift unit 31 is shifted in a while to apply a voltage again to the pair of the electrodes 19*a* and 19*b*, thereby making the temperature of the mold 25 in the positions P1 and P2 higher than in the positions P3 and P4. Thereafter, the such operation for shifting the temperature of the mold 25 is repeated at small intervals in the manner as shown in FIG. 10.

By alternately applying the current to the mold 25 by means of two groups of the pairs of the electrodes 19*a* and 19*b* as well as 19*c* and 19*d*, respectivedly, a maximum temperature difference among the positions of the mold 25 becomes gradually smaller and eventually reaches the sintering temperature, as shown in FIG. 9 (in this embodiment, approximately 900° C.). At this point, the maximum temperature difference is reduced to a level as small as 20–3° C. It is to be noted herein that the figure indicated in FIG. 10 represents the temperature difference at each point.

Then, the mold 25 is maintained at the sintering temperature for a predetermined period of time; followed by suspending the application of the current to the electrodes 19 (in the state as shown in FIG. 4), thereby cooling the mold 25 by means of the electrodes 19*a*, 19*b*, 19*c* and 19*d* serving as cooling bars.

As the temperature of the mold 25 is lowered to a predetermined discharging temperature (in this embodiment, approximately 200° C.), the application of the pressure by means of the upper and lower punches 26 and 27 is suspended. At the same time, the lid member 9 of the vacuum chamber 7 is opened by the cylinder unit 17 to discharge the mold 25 from the vacuum chamber 7 by means of the mold lift bar 4, as shown in FIG. 2. Thereafter, a sintered article as a product is discharged from the mold 25, and the mold 25 is transferred for reuse in another sintering process.

Figure 11:
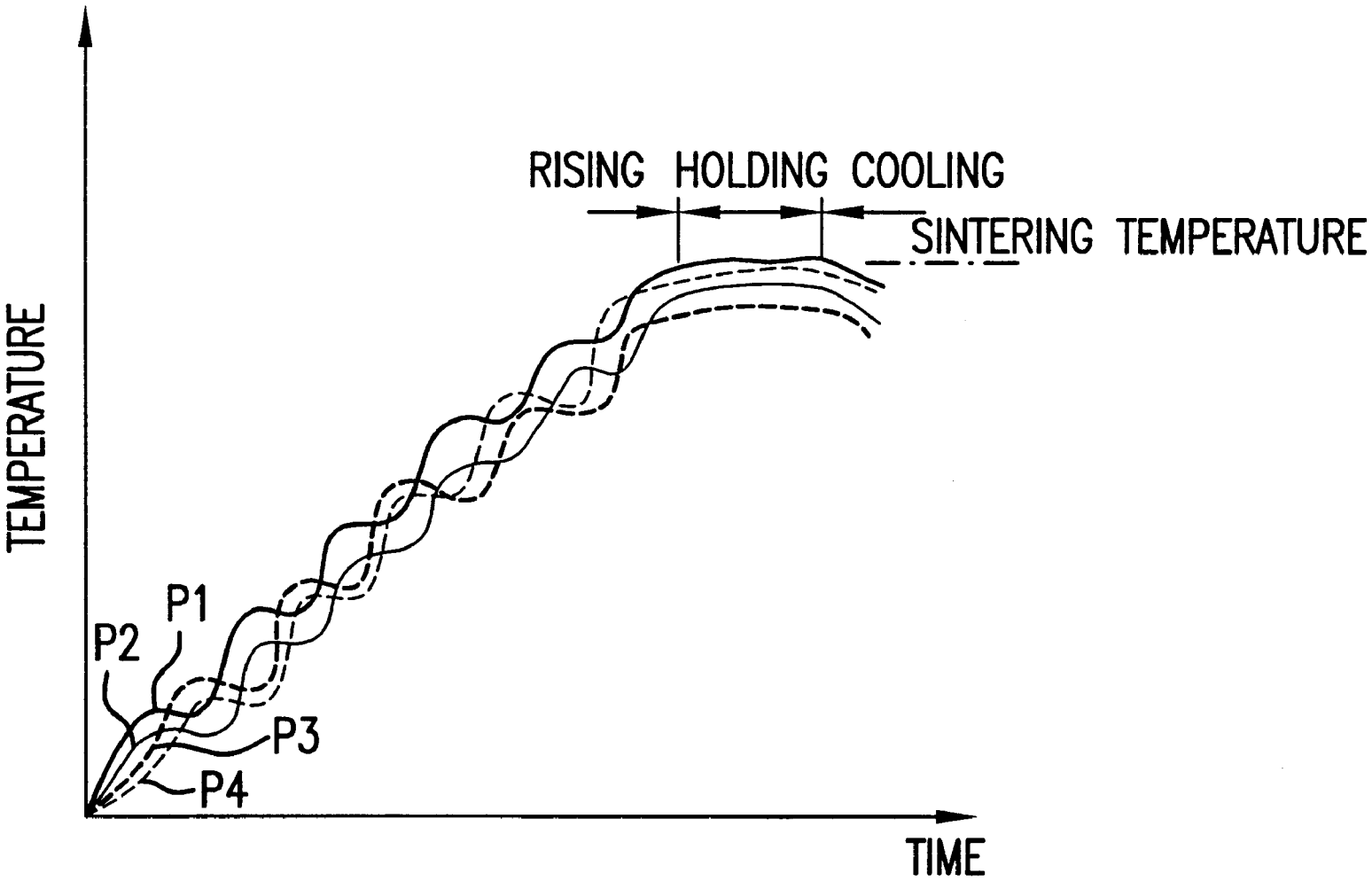
FIG. 11 is a graph showing an example of controlling a rise in temperature of a mold by a pair of electrodes of each of two groups facing each other in accordance with a second embodiment of the present invention.
Figure 12:
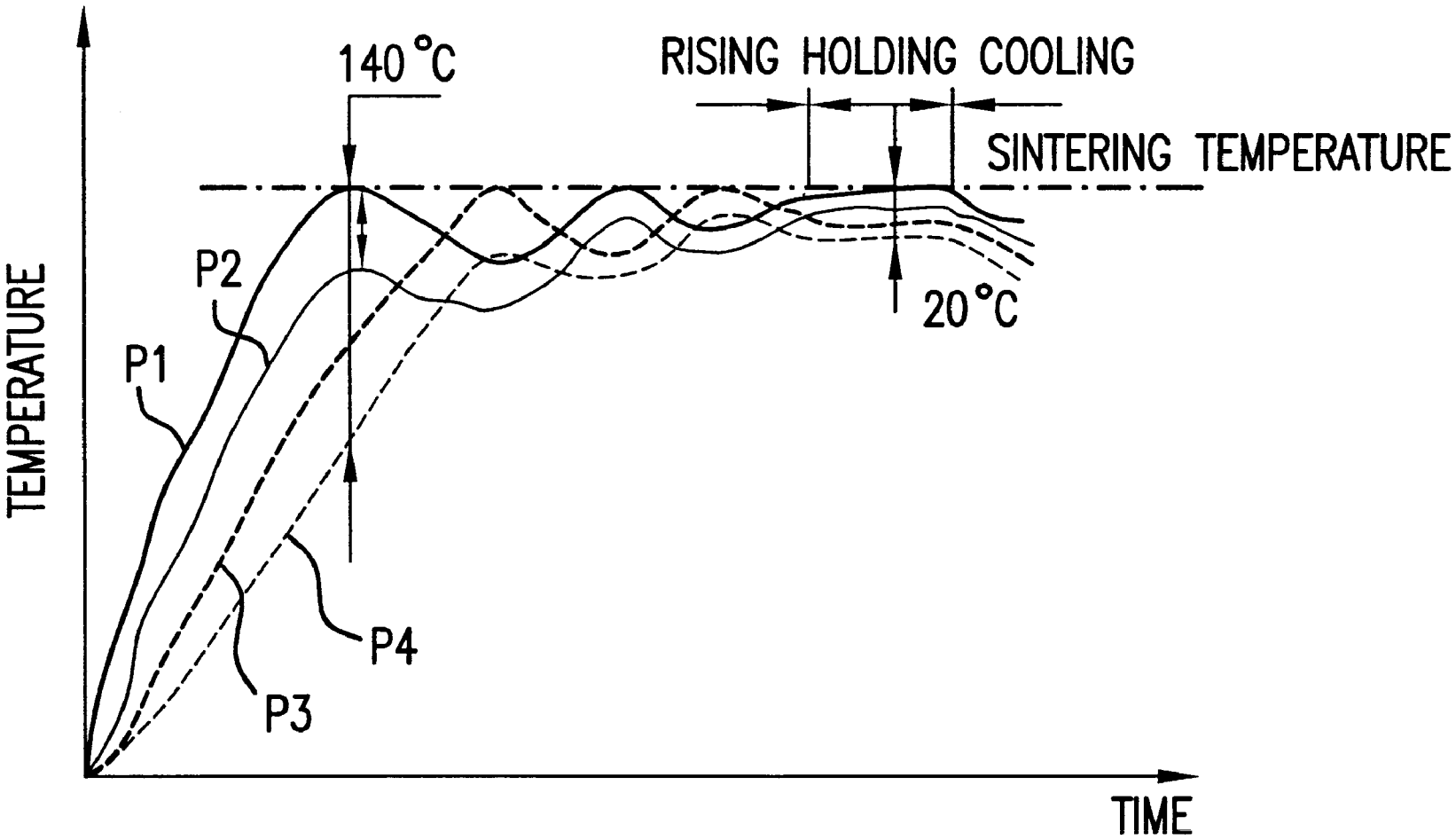
FIG. 12 is a graph showing an example of controlling a rise in temperature of a mold by a pair of electrodes of each of two groups facing each other in accordance with a third embodiment of the present invention.
Figure 13:
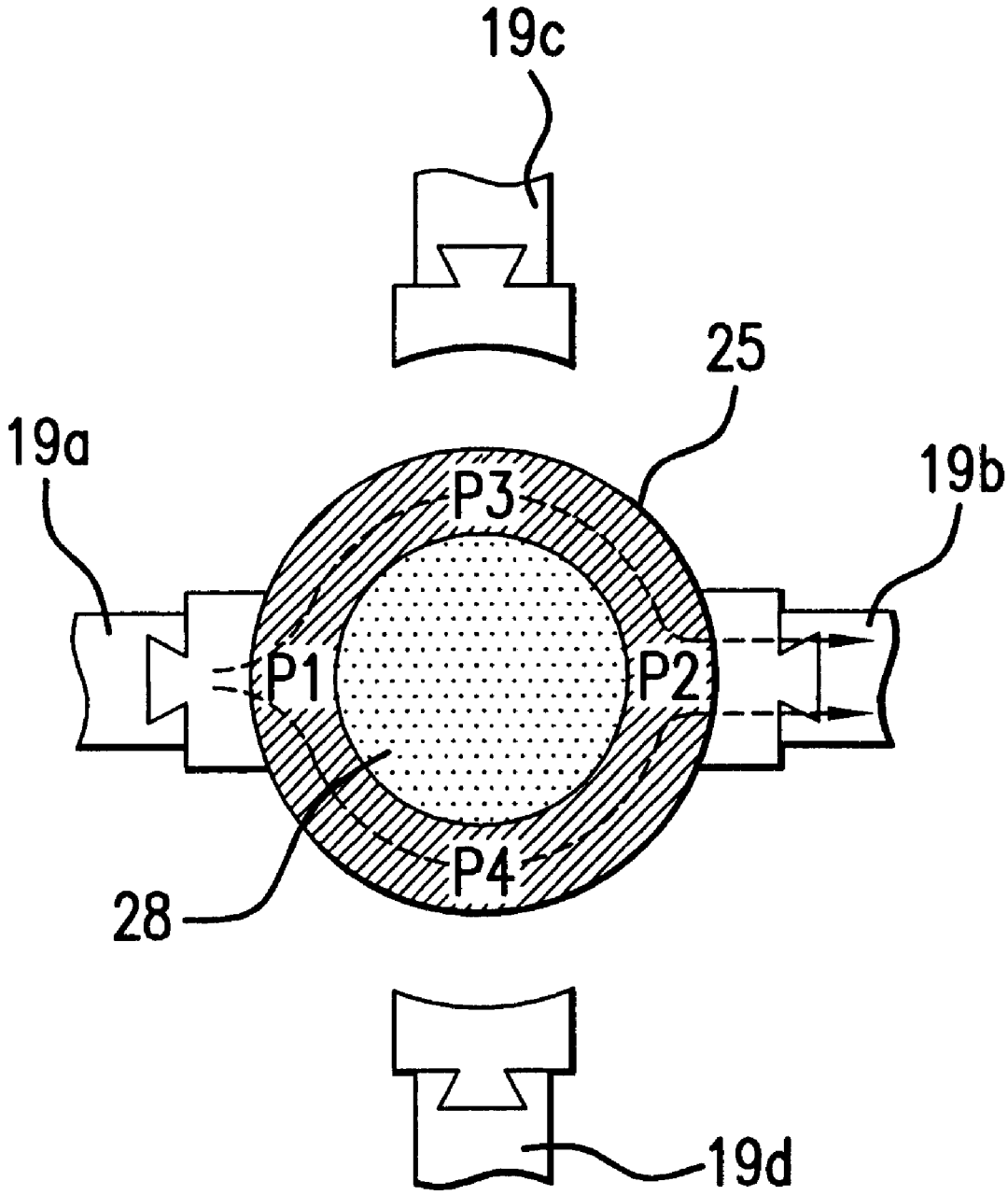
FIG. 13 is a schematic view describing a fourth embodiment of the present invention.

FIG. 11 shows a second embodiment of the present invention; FIG. 12 a third embodiment thereof; FIG. 13 a fourth embodiment thereof; FIGS. 14–17 a fifth embodiment thereof; and FIG. 18 a sixth embodiment thereof. In each of the second–sixth embodiments, the same structuring elements as in the first embodiment thereof are provided with the same reference numerals.

The second embodiment as shown in FIG. 11 is a variation of a control example for elevating the temperature of the mold 25 (the powder material 28) up to the sintering temperature. In the second embodiment, the current is applied alternately to each of the groups of the pairs of the electrodes 19*a* and 19*b* as well as 19*c* and 19*d* piecemeal at a short time interval from the start of applying the current thereto.

This embodiment can make the temperature difference in the mold 25 at the time of sintering extremely small, as shown in FIG. 11.

The third embodiment as shown in FIG. 12 is another variation of a control example for elevating the temperature of the mold 25 (the powder material 28) up to the sintering temperature. In the third embodiment, the current is first applied to the one group of the pair of the electrodes 19*a* and 19*b* only until the temperature of the mold 25 in the positions P1 and P2 is rapidly raised to the level close to the sintering temperature.

Thereafter, the current is alternately applied to each of the groups of the pairs of the electrodes 19*a* and 19*b* as well as to 19*c* and 19*d* piecemeal at a short time interval, in order to adjust the elevation of the temperature in the mold 25.

This embodiment can make the local temperature difference small at the portion of the mold 25 at the time of sintering as well as shorten the treatment period of time up to the sintering point at which the sintering is effected.

The fourth embodiment as shown in FIG. 13 is configured such that, in order to shift the contact points at which a pair of the electrodes contact with the mold for applying the current thereto from the corresponding pair thereof, two groups of the pairs of the opposing electrodes 19*a* and 19*b* as well as 19*c* and 19*d* are disposed on the periphery of the mold 25 and the group consisting of the pair of the opposing electrodes 19*a* and 19*b* or 19*c* and 19*d* are moved so as to alternately contact with or separate apart from the side surfaces of the mold 25. In this case, as a matter of course, a voltage is applied to the pair of the electrodes 19 which contact with the side surfaces of the mold 25, and the movement of the electrodes 19 can be controlled by means of a control unit, although not shown in the drawing.

This embodiment can perform the like action and effects as achieved by the first embodiment.

The fifth embodiment as shown in FIGS. 14 to 17 is configured such that a period of time during which no current is being applied partially is set during the step of sintering by applying the current thereto.

In the fifth embodiment, the vacuum chamber 7 is provided with two insertion holes 18 in the opposite positions, and the electrodes 19*a* and 19*b* are inserted into the respective insertion holes 18. To each of the electrodes 19*a* and 19*b* is connected an electric power 22 through a shift unit 31. A terminal 37 (38) of the electric power 22 is connected to or disconnected from a connecting terminal 33 (35) of the shift unit 31 on the basis of the activation of an actuator 36 of the shift unit 31.

To each of the electrodes 19*a* and 19*b* is connected a gas cylinder unit 23 fixed by means of a fixing means, although not shown. Each of the gas cylinder units 23 is connected to a changeover valve 52 (of an electromagnetic type) through a feed tube 51*a* and a discharge tube 51*b*. To the changeover valve 52 is in turn connected a compressor 53 functioning as a source for compressed air. Compressed air is supplied from the compressor 53 to each of the gas cylinder units 23 through the changeover valve 52, and the compressed air is discharged from each of the gas cylinder units 23 by means of the changeover valve 52. This configuration allows each of the electrodes 19 to come closer to or separate apart from the side surface of the mold 25.

Figure 15:
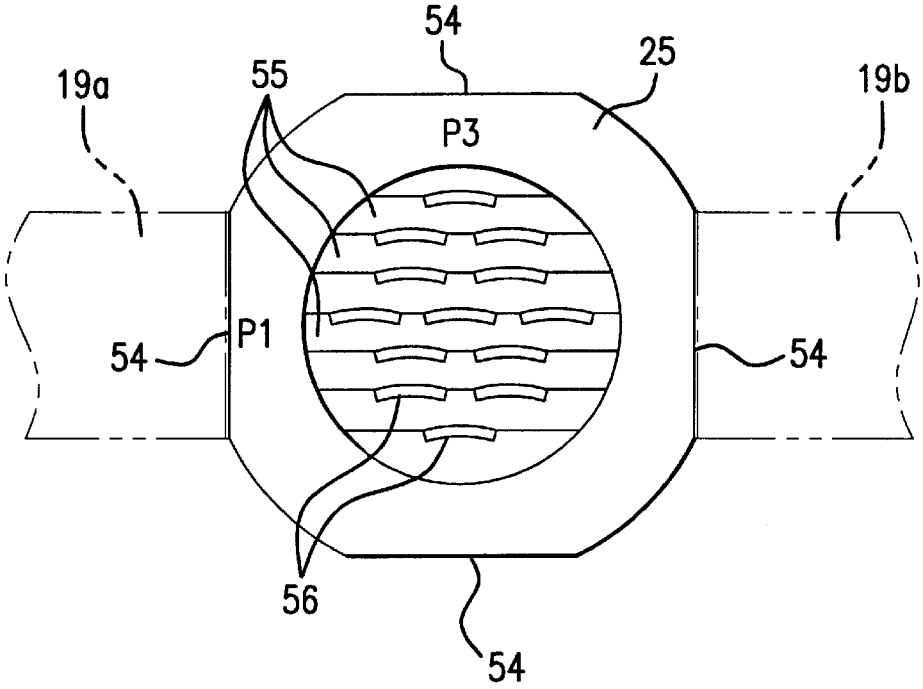
FIG. 15 is a plan view showing a mold for use in the fifth embodiment of the present invention.

As shown in FIG. 15, the mold 25 in the vacuum chamber 7 has two groups of pairs of flat contact surfaces 54 on its side surface (its outer side surfaces), each group consisting of a pair of the flat contact surfaces 54. One group of the pair of the flat contact surfaces 54 out of the two groups thereof is located in a region in which the corresponding electrodes 19 can be moved. On sintering by applying the current to the mold 25, the tip portion of the electrode 19 is allowed to contact with the corresponding flat contact surface 54 in order to avoid a local contact as much as possible.

Figure 16:
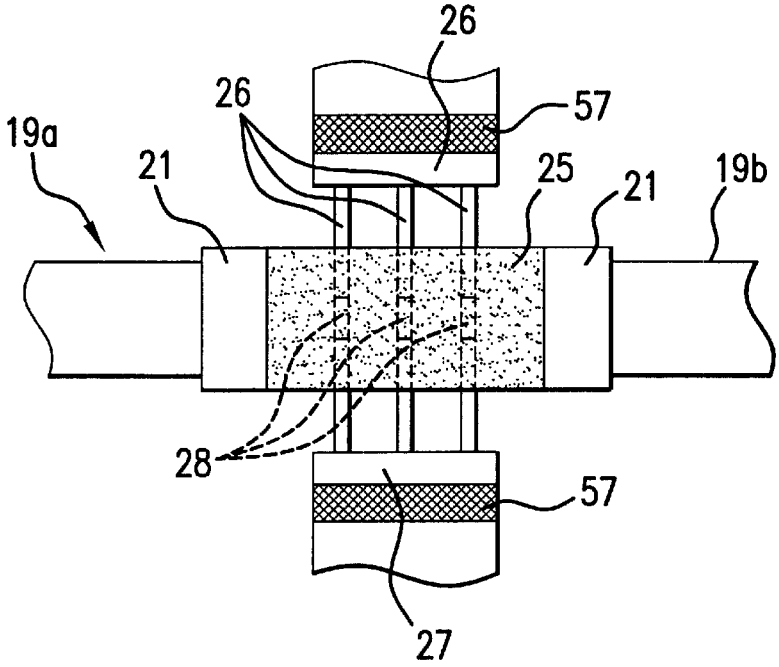
FIG. 16 is a schematic view showing upper and lower punches for use in the fifth embodiment of the present invention.

As shown in FIG. 15, in this embodiment, the mold 25 is loaded with a split mold 55 consisting of a plurality of divided mold sections. The divided mold sections of the split mold 55 are provided with a plurality of holes 56 which are filled with the powder material 28. The powder material 28 filled therein is pressed by means of the upper and lower punches 26 and 27 in order to provide the powder material 28 with pressure. Each of the upper and lower punches 26 and 27 is provided with an insulating material 57 having resistance to heat (i.e., a ceramics material such as silicon nitride, etc.), as shown in FIG. 16, by taking advantage of the fact that the upper and lower punches 26 and 27 are not required to have the function of applying the current to the mold 25. The insulating material 57 can present the effect of efficiently controlling the heat of the mold 25 from leaking outside through the powder material 28 and the upper and lower punches 26 and 27.

Figure 14:
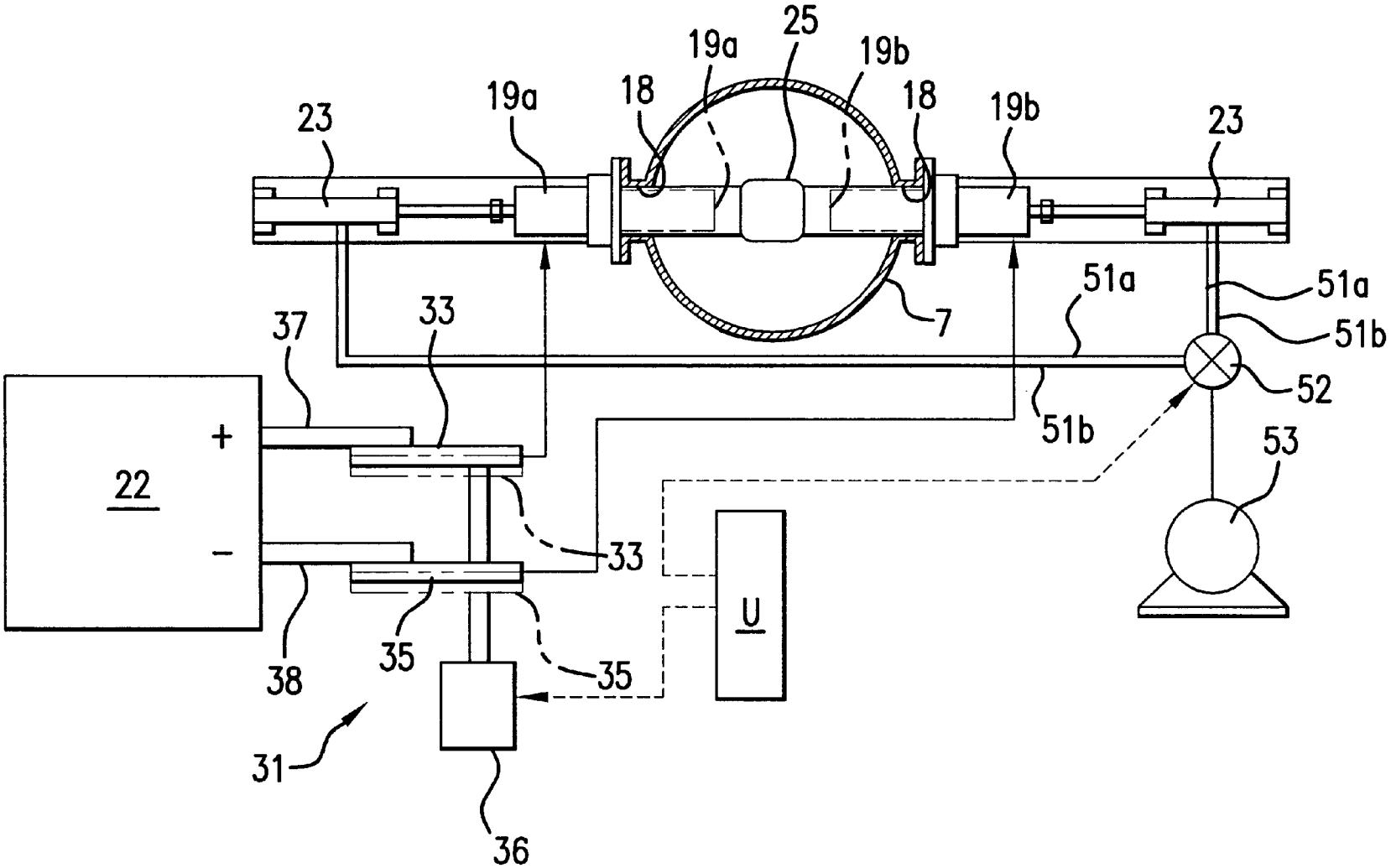
FIG. 14 is a schematic view showing a sintering apparatus according to a fifth embodiment of the present invention.

As shown in FIG. 14, the actuator 36 and the changeover valve 52 are controlled by a control unit U. The control unit U can basically provide the functions of activating the actuator 36 to allow the terminal 37 (38) of the direct current power source 22 to contact with a connecting terminal 33 (35) of the shift unit 31 to apply voltage to each of the electrodes 19 when the sintering is carried out by applying the current to the mold 25. At the same time, the control unit U activates the gas cylinder unit 23 by controlling the changeover valve 52 and allows the tip portion 21 of each of the electrodes 19*a* and 19*b* to contact with the side surface of the mold 25. When the sintering starts on applying the current to the mold 25 after contact of the electrodes 19*a* and 19*b* with the mold 25, the temperature at each of the positions (P1 and P2 in FIG. 15) of the mold 25 starts elevating gradually in the manner as shown in FIG. 17 and transmitting heat to the powder material 28 in the mold 25.

In this case, there is the tendency that a portion of the mold 25 may locally become higher in a speed of the elevation of temperature than the other portions thereof due to the limitations to the small contact face between the side surface of the mold 25 and each of the electrodes 19 or a processing precision for processing the side surface of the mold 25 or for the material (e.g., graphite) of the mold 25 or for other reasons. The local occurrence of the portion in the mold 25 where the temperature arises faster than the other may lead to the fact that a temperature difference in the mold 25 may become gradually larger as time elapses (as indicated in FIG. 17 by temperature characteristic line (including dot-dash line) in the position P1 of the mold 25 and by temperature characteristic line in the position P3 of the mold 25).

In order to avoid this, this embodiment of the present invention is configured in such a manner that the application of the current to the mold 25 is partially suspended several times at the time of a rise of the temperature during the step of sintering by applying the current thereto. Although the period of time during which the application of the current is suspended may be set optionally, it is preferred that the period of time may be set so as for the elevation of temperature at the portion of the mold 25 where the temperature is lower than all the other portions to fail to turn lowering. More specifically, the suspending period of time may range from, e.g., 5 seconds to 20 seconds.

Figure 17:
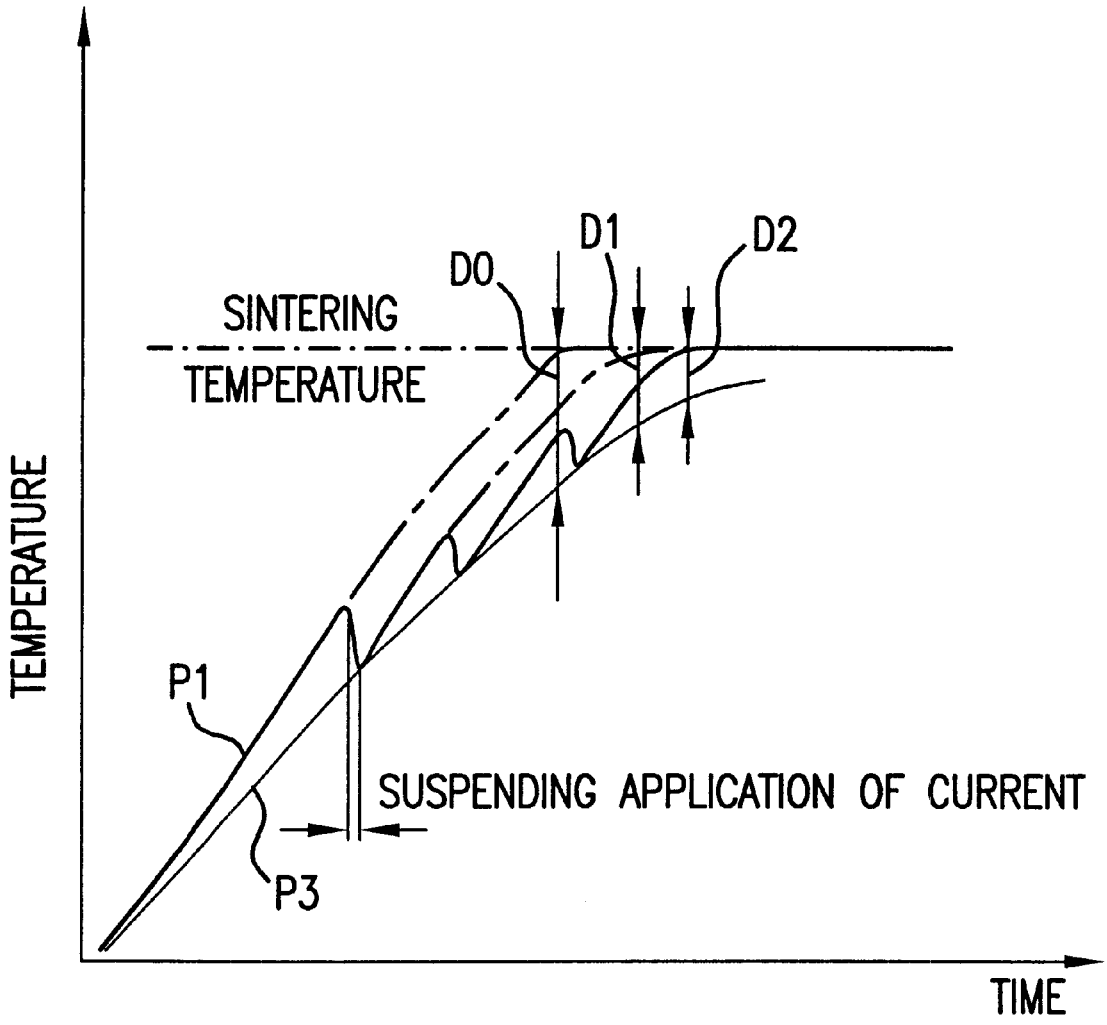
FIG. 17 is a schematic view describing a sintering method by application of a current in accordance with the fifth embodiment of the present invention.

As shown in FIG. 17, by intermittently suspending the application of the current to the mold 25, the heat in the position P1 of the mold 25 is allowed to be transmitted to the other portions where the temperature is lower, and as a consequence a temperature difference in the mold 25 between the portion where the temperature is higher and the portion where it is lower may become smaller. The temperature difference can be made effectively smaller by increasing times of suspending the application of the current to the mold 25. The effects to be provided by making the temperature difference smaller are indicated by differences D0, D1 and D2 in FIG. 17. The differences D0 as indicated by two-dots-dash line, D1 as indicated by a dot-dash line, and D2 as indicated by solid line, represent temperature differences from the line P3 which indicates the case where no application of a current is suspended.

It is further noted herein that, on suspending the application of the current to the mold 25, the electrode 19*a* (19*b*) can be separated apart from the side surface of the mold 25, in addition to the structure in which the upper and lower punches 26 and 27 are provided each with the insulating material 57, so that the heat in the mold 25 and the powder material 28, in particular the heat at the portion of the mold 25 where the temperature is higher, can be prevented from being leaked toward the outside. Therefore, the heat in the mold 25 and so on can be greatly utilized effectively for leveling the temperature in the mold 25.

Figure 18:
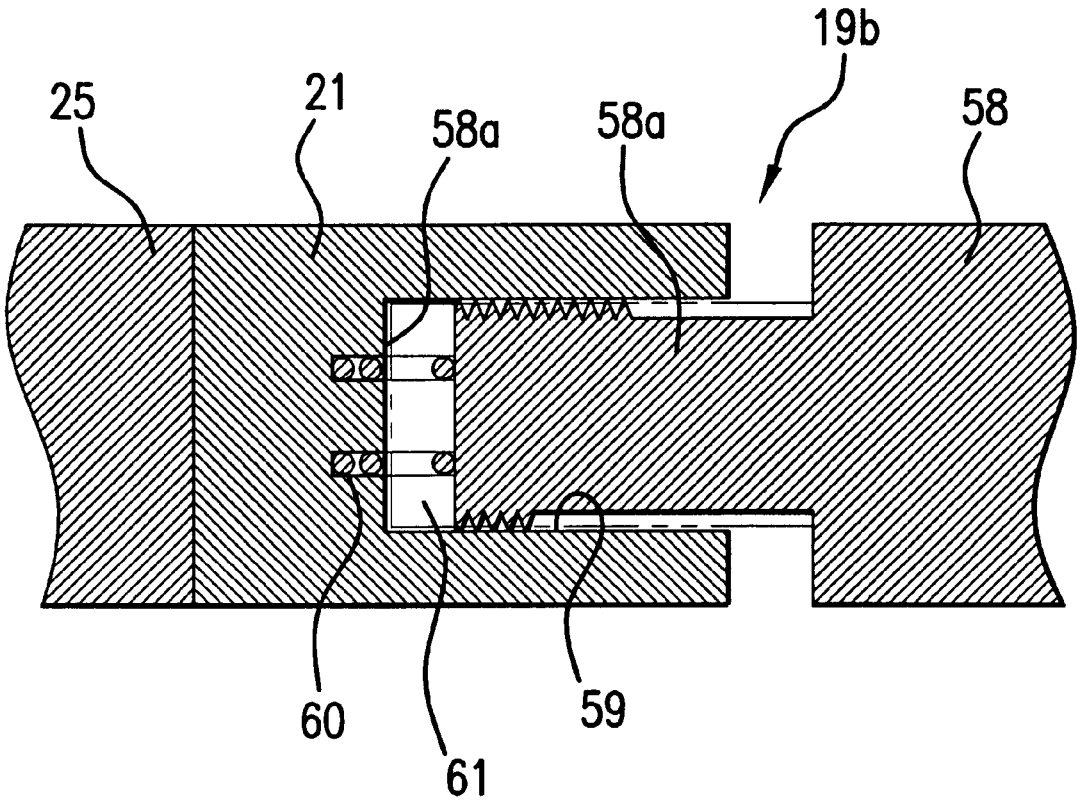
FIG. 18 is a schematic view showing electrodes in accordance with a sixth embodiment of the present invention.
Figure 19:
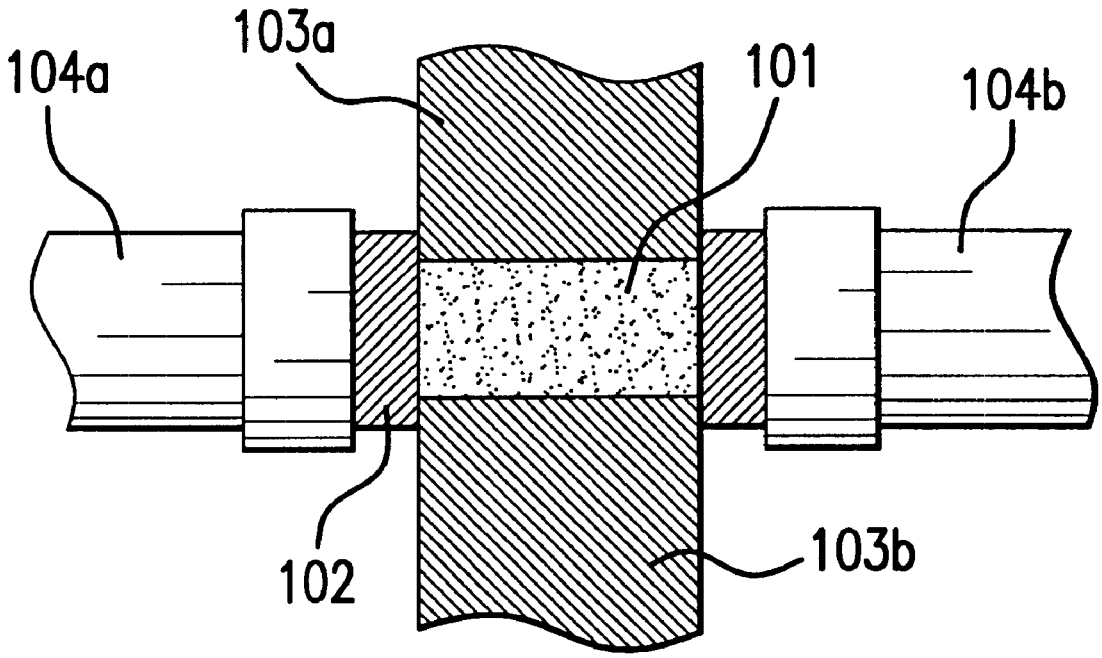
FIG. 19 is a view showing a relationship between upper and lower punches in a sintering apparatus of prior art.
Figure 20:
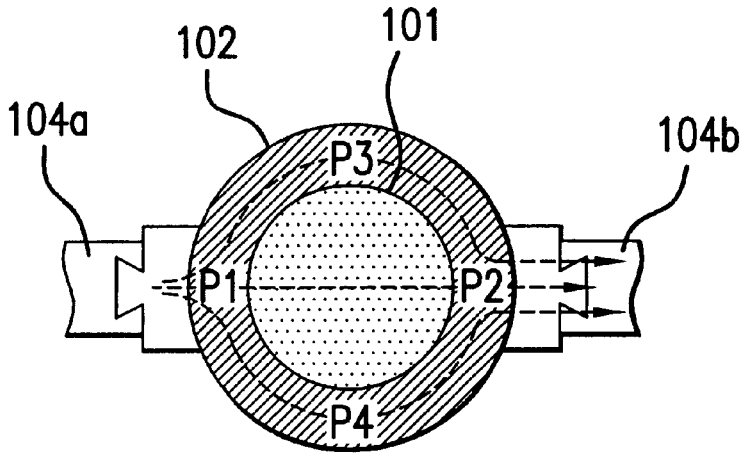
FIG. 20 is a transversely sectional view of FIG. 19.
Figure 21:
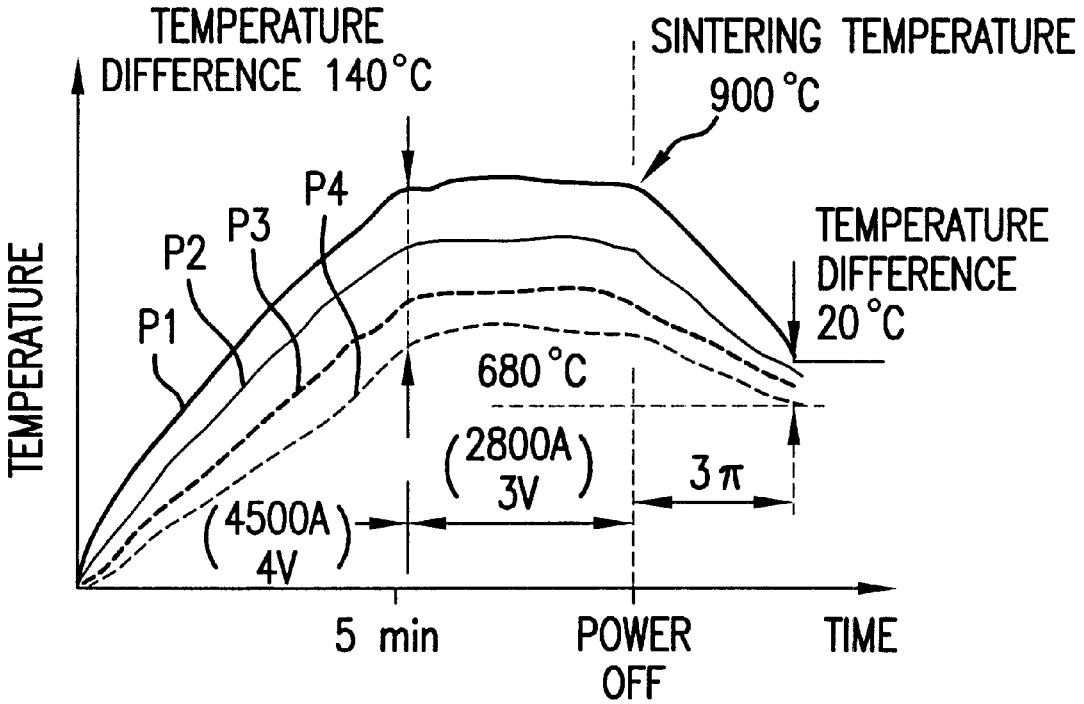
FIG. 21 is a graph showing an example of controlling a rise of temperature by a pair of electrodes as shown in FIGS. 19 and 20.

The sixth embodiment of the present invention as shown in FIG. 18 is a variation of the fifth embodiment, in which the electrode 19*a* or 19*b* is stayed in contact with the side surface of the mold 25 upon partially suspending the application of the current to the mold 25 during the step of sintering by applying the current thereto.

Each of the electrodes 19*a* and 19*b* to be utilized for the sixth embodiment may be of a two-part structure consisting of a tip part 21 and a main body part 58. The tip part 21 of each of the electrodes 19*a* and 19*b* is formed on its rear end side with a relatively long engagement hole 59 with which is slidably engaged a tip portion 58*a* of the main body part 58 with a male screw formed in order to reduce a contact area. Between a bottom surface of the engagement hole 59 of the tip portion 21 and the tip end surface of the tip portion 58*a* thereof is interposed a heat-resistant coil spring 60. The coil spring 60 is configured such that, when an external force is applied thereto, it serves as separating the bottom surface of the engagement hole 59 in the tip portion 21 from the tip end surface of the tip portion 58*a* thereof, thereby forming a space area 61 between the tip portion 21 and the main body part 58.

On using the electrodes 19*a* and 19*b*, the tip portion 21 of them is allowed to contact with the side surface of the mold 25 by means of the gas cylinder unit 23 during a period of time of applying the current to the mold 25. At the same time, the bottom surface of the engagement hole 59 in the tip portion 21 is allowed to contact with the tip end surface 58*a* of the main body part 58. This configuration can apply the current to the mold 25 through the main body part 58 and the tip portion 21.

On the other hand, when the application of the current is to be partially suspended during the step of sintering by applying the current, the pressing force of the gas cylinder unit 23 is weakened and the tip portion 21 of the electrode 19*a* (19*b*) is stayed in contact with the side surface of the mold 25, while the bottom surface of the engagement hole 59 in the tip portion 21 is allowed to separate apart from the tip end surface of the tip part 58*a* of the main body part 58 to form the space area 61 that serves as an insulating area. Thus, the space area 61 can control the heat in the mold 25 and the like from leaking away toward the outside through the electrodes 19*a* and 19*b*.

The seventh embodiment of the present invention is a variation of the first embodiment in which two groups of the electrodes 19*a* and 19*b* as well as 19*c* and 19*d*, which can be shifted, are provided (as shown in FIG. 4) and the application of the current is suspended in association with the shifting of the two groups of the electrodes 19*c* and 19*d* as well as 19*c* and 19*d*.

In this embodiment, each of the electrodes 19*a* and 19*b* (19*c* and 19*d*) may be disposed so as to separate apart from the side surface of the mold 25 upon suspending the application of the current thereto, as in the fifth embodiment, or so as to form the space area 61 in each of the electrodes, while the electrodes 19*a* and 19*b* (19*c* and 19*d*) are in contact with the side surface of the mold 25, as in the sixth embodiment.

In each of the above embodiments, a description of an insulating material is omitted for brevity of explanation. It is to be noted herein, however, that an insulating material such as Teflon® or bakelite may be used at an appropriate location or for an appropriate element (or member), in order to cause no leakage of a current or for other reasons.

Although the present invention has been described with reference to the embodiments as described above, it is understood that the present invention encompasses within the scope and spirit of the invention illustrative embodiments as will be described hereinafter.

(1) In order to shift contact points of a mold with which a pair of electrodes contact for applying a current thereto, a pair of the electrodes 19 may be disposed on the periphery of the mold 25. The pair of the electrodes 19 may be rotated relatively to the mold 25 by means of a relative rotation means and deviated from their original positions by a predetermined distance in the peripheral direction of the mold 25 as time elapses. The relative rotation means may be preferably configured in such a manner that it rotates coaxially about the mold lift bar 4, i.e. it acts, for example, as a turn table. This embodiment can perform the action and effects as can be achieved particularly by the first and fourth embodiments, in addition to the effect that the number of electrodes can be minimized.

(2) A thermocouple may be installed in the inside of the electrode 19, and the electrode 19 is allowed to contact with the side surface of the mold 25, thereby enabling the temperature of the mold 25 to be detected with ease.

(3) In place of the cooling cylinder 20, a cooling path may be formed within the electrode 19. By passing a cooling medium through the cooling path, the number of parts can be reduced while performing cooling effects as can be achieved by the disposition of the cooling cylinder 20.

(4) The number of partially suspending the application of the current can be limited to one during the step of sintering by applying the current to the mold 25.

(5) In each of the fifth, sixth and seventh embodiments, the application of the current to the mold 25 may be suspended as the temperature difference at each portion of the mold 25 reaches a predetermined level. This embodiment can prevent the temperature difference in the mold from becoming too big. In this case, as a matter of course, the temperature at each portion of the mold 25 can be detected by using the temperature detector 45 or other means, information on the temperature detected is inputted into the control unit U, and the control unit U is controlled on the basis of the information on the temperature inputted.

What is claimed is:

1. A sintering method for sintering a powder material in a mold by applying a current to a cylindrical mold for accommodating said powder material under a pressurized condition in such a state in which a pair of electrodes are in contact with a side surface of said cylindrical mold with the powder material filled in said cylindrical mold and heat is supplied to the powder material in said mold, and varying with time the location at which said pair of electrodes contacts said side surfaces of said cylindrical mold.

2. The sintering method as claimed in claim 1, wherein:

three or more electrodes are disposed in a peripherally spaced relationship on a periphery of said mold; and two optional electrodes are selected from said three or more electrodes as time elapses, to form said pair of electrodes.

3. The sintering method as claimed in claim 1, wherein:

a group of a pair of electrodes is disposed on a periphery of said mold; and said group of said pair of electrodes is deviated in a peripheral direction of said mold relative to said mold, as time elapses.

4. The sintering method as claimed in claim 2, wherein:

said three or more electrodes are all in contact with the side surfaces of said mold; and said two optional electrodes are selected by shifting application of a current thereto.

5. The sintering method as claimed in claim 2, wherein:

said two optional electrodes are selected by causing said electrodes to contact with or separate apart from the side surfaces of said mold.

6. The sintering method as claimed in claim 4, wherein:

two groups each composed of a pair of electrodes are selected from said three or more electrodes; and said two groups of pairs of electrodes are disposed so as for a virtual line connecting said pair of electrodes of a one group of a pair of electrodes to each other to intersect another virtual line connecting another group of a pair of electrodes to each other; and a current is alternately applied to said groups of pairs of electrodes.

7. The sintering method as claimed in claim 6, wherein:

said one group of a pair of electrodes selected from said two groups of pairs of electrodes is applied with a current at an initial time of applying the current thereto to allow temperature of said mold to reach a predetermined temperature; and the current is then intermittently applied at a short time interval alternately to each of said two groups of pairs of electrodes.

8. A sintering method for sintering a powder material in a mold by applying a current to a cylindrical mold, wherein application of the current for sintering said powder material is partially suspended, and said sintering method comprising the step of applying heat to said powder material in said mold by applying the current to said mold while a pair of electrodes are in contact with a side surface of said mold with said powder material filled therein under a pressurized condition.

9. The sintering method as claimed in claim 8, wherein:

said pair of electrodes are separated apart from the side surface of said mold upon suspending the application of the current for sintering said powder material.

10. The sintering method as claimed in claim 8, wherein:

each of said electrodes is disposed so as for a tip portion thereof to come closer to or separate apart from a main body in such a manner that, when the tip portion of said each of said electrodes is separated apart from said main body, a space area is formed between the tip portion of said each of said electrodes and said main body; and on suspending the application of the current for sintering said powder material, said space area is formed by separating the main body of said each of said electrodes apart from the tip portion thereof while the tip portion of said each of said electrodes contacts with the side surface of said mold.

11. The sintering method as claimed in claim 8, wherein:

said three or more electrodes are disposed in a peripherally spaced relationship on the periphery of said mold;

two optional electrodes are selected from said three or more electrodes by shifting said electrodes, as time elapses, to form said pair of electrodes; and on selecting said two optional electrodes by shifting said electrodes, a period of time for suspending the application of the current is provided for suspending the application of the current for sintering said powder material.

12. The sintering method as claimed in claim 8, wherein:

said mold is made of graphite.

13. The sintering method as claimed in claim 8, wherein:

the application of the current is suspended when a temperature difference between two predetermined positions of said mold reaches a predetermined temperature difference or larger.

14. The sintering method as claimed in claim 8, wherein:

pressure is applied to said powder material in a state in which heat is insulated from outside.

15. The sintering method as claimed in claim 8, wherein:

suspending the application of the current to said mold is performed plural times.

16. A sintering apparatus for sintering a powder material filled in a cylindrical mold for accommodating said powder material under a pressurized condition by applying a current to said mold with a pair of electrodes disposed on a periphery of said mold in a state that said pair of electrodes are in contact with a side surface of said mold for supplying heat to said mold; wherein:

plural groups, each group composed of said pair of electrodes, are disposed in contact with the peripheral side surface of said mold so as to alternately apply the current to said mold.

17. A sintering apparatus for sintering a powder material filled in a cylindrical mold for accommodating said powder material under a pressurized condition by applying a current to said mold with a pair of electrodes disposed on a periphery of said mold in a state that said pair of electrodes are in contact with a side surface of said mold for supplying heat to said mold; wherein:

plural groups, each group composed of a pair of electrodes, are disposed on the periphery of said mold so as to alternately come into contact with the side surface of said mold; and the group of a pair of electrodes in contact with the side surface of said mold comprises said pair of electrodes for applying the current to said mold.

18. A sintering apparatus, comprising:

a pair of electrodes disposed on a periphery of a cylindrical mold for accommodating a powder material under a pressurized condition for applying heat to said powder material by applying a current to said mold;

a current-application adjusting means for adjusting application of the current to said pair of electrodes from a power source; and a control means for controlling said current-application adjusting means to assume a current-applying state at a usual time in which the current is applied to said pair of electrodes from the power source and a current-application suspending state in which the application of the current to said pair of electrodes is partially suspended.

19. The sintering apparatus as claimed in claim 18, wherein:

pressure is applied to said powder material from both sides of said mold in axial directions of said mold by means of a pressurizing punch having a heat insulating layer.

20. The sintering apparatus as claimed in claim 18, wherein:

said mold is made of graphite.

21. The sintering apparatus as claimed in claim 18, wherein:

said pair of electrodes are composed of a group selected from said plural groups of pairs of electrodes which are disposed so as to be shifted in sequence; and a control means is set so as to perform said current-application suspending state by controlling said current-application adjusting means when it is judged that a temperature difference in two positions out of said plural positions reaches a predetermined temperature difference or larger on the basis of a signal from said mold temperature detecting means.

22. The sintering apparatus as claimed in claim 18, further comprising:

a mold temperature detecting means for detecting a temperature of said mold in plural positions; wherein:

a control means is set so as to perform said current-application suspending state by controlling said current-application adjusting means when it is judged that a temperature difference in two positions out of said plural positions reaches a predetermined temperature difference or larger on the basis of a signal from said mold temperature detecting means.

23. The sintering apparatus as claimed in claim 16, wherein:

a temperature detector is disposed so as to contact with or separate apart from the side surface of said mold.

24. The sintering apparatus as claimed in claim 16, wherein:

a thermocouple is disposed in a tip portion of said electrode.

* * * * *